United States Patent [19]

Matsuoka et al.

[11] 4,365,250

[45] Dec. 21, 1982

[54] GARAGE DOOR OPERATION CONTROL APPARATUS

[75] Inventors: Shigeru Matsuoka; Takeshi Tokunaga; Seiji Yonekura; Mituo Suzuki; Kenji Nakamura, all of Hitachi, Japan

[73] Assignee: Hitachi, Ltd., Tokyo, Japan

[21] Appl. No.: 140,672

[22] Filed: Apr. 15, 1980

[30] Foreign Application Priority Data

Apr. 19, 1979 [JP] Japan ..... 54-48402

[51] Int. Cl.[3] ..... G06F 7/04; G08C 19/00

[52] U.S. Cl. ..... 340/825.32; 340/825.37; 340/825.72; 340/539; 340/541; 340/506; 49/25; 49/31; 318/16; 318/266

[58] Field of Search ..... 340/694-696, 340/539, 506, 531, 534, 540, 541, 164 R, 825.37, 825.32, 825.31, 825.72, 825.69; 455/352, 353, 603; 364/550; 49/25, 31; 318/16, 266, 466, 467, 468, 469, 581

[56] References Cited

U.S. PATENT DOCUMENTS

| | | | |
|---|---|---|---|
| 4,006,460 | 2/1977 | Hewitt et al. | 340/164 R |
| 4,048,630 | 9/1977 | Deming et al. | 340/694 |
| 4,074,269 | 2/1978 | Hartley | 340/694 |
| 4,189,719 | 2/1980 | Massa et al. | 340/164 R |
| 4,197,675 | 4/1980 | Kelly | 49/31 |

*Primary Examiner*—Thomas A. Robinson
*Assistant Examiner*—Donnie L. Crosland
*Attorney, Agent, or Firm*—Antonelli, Terry & Wands

[57] ABSTRACT

A garage door operation control apparatus includes a door operating system for opening and closing the main door of a garage, a main detection circuit for detecting the open or closed condition of the main door, an auxiliary detection circuit for detecting an open condition of a window or an auxiliary door of the garage, a fire in the garage or generation of a special gas therein, an alarm and a signal processing circuit. Electrical signals from the detection circuit are logically analyzed thereby to control the door operating system and the alarm.

14 Claims, 49 Drawing Figures

GARAGE DOOR OPERATION CONTROL APPARATUS

The present invention relates to a garage door operating device or more in particular to garage door operation control apparatus capable of accurate control by detecting an abnormal condition within a garage.

A conventional garage door operation control apparatus so far suggested is such that the garage door is driven by a motor. This motor is connected to a power supply through a relay circuit controlled by a push button switch or a radio control switch for issuing a motor command signal, thus driving the door in the desired direction. Such a control apparatus for a motor-driven door is disclosed in U.S. Pat. No. 3,178,627 invented by Richard D. Houk and patented Apr. 13, 1965 and U.S. Pat. No. 3,906,348 invented by Colin B. Willmott and patented Sept. 16, 1975.

Generally, a garage is often used to store a variety of articles in addition to a motor vehicle. Therefore, adequate care must be taken to prevent them from generating a fire or being stolen. For the purpose of detecting a fire or an article being stolen, a fire detector for detecting a fire by flame or smoke and an intruder preventing device using a light shield, a reed switch or an electric wave are sold on the market. If these ready-made devices are purchased and installed within the garage, the inconveniences as mentioned below result.

Firstly, an abnormal condition detector such as a fire detector or an intruder preventing device will be installed separately from a door operation control apparatus, with the result that the former and the latter are not operatively related to each other, and therefore an accident or damage is not effectively prevented.

Secondly, in view of the fact that the abnormal condition detector such as the fire detector or the intruder preventing device is installed separately from a door operation control apparatus, a plurality of parts having the same functions, a single one of which otherwise might serve the purpose, are used uneconomically.

Thirdly, in view of the fact that the abnormal condition detector such as a fire detector or an intruder preventing device is installed separately from a door operation control apparatus, two power wiring systems are required, thus complicating the wiring work on the one hand and making the operation of a power switch troublesome on the other hand.

Accordingly, it is an object of the present invention to provide a garage door operation control apparatus capable of controlling the garage door efficiently by integrating the control of the garage door operation with the processes for detecting an abnormal condition in the garage.

According to the present invention, there is provided a garage door operation control apparatus comprising door operating means for operating the main door of a garage, main detection means for detecting an operating condition of the main door, auxiliary detecting means for detecting an open condition of a window or an auxiliary door of the garage or a fire or a special gas generated in the garage, alarm means, and signal processing means, wherein an electrical signal from the detecting means is logically analyzed thereby to control the door operating means and the alarm means.

The above and other objects, features and advantages will be made apparent by the detailed description taken in conjunction with the accompanying drawings showing embodiments of the present invention, in which.

Figure 44A:
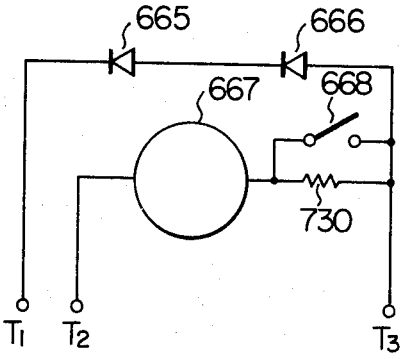
Figure 44B:
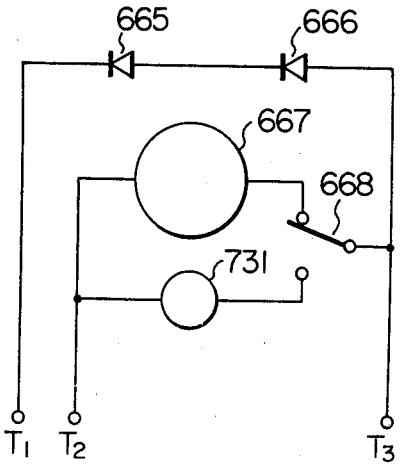
Figure 45:
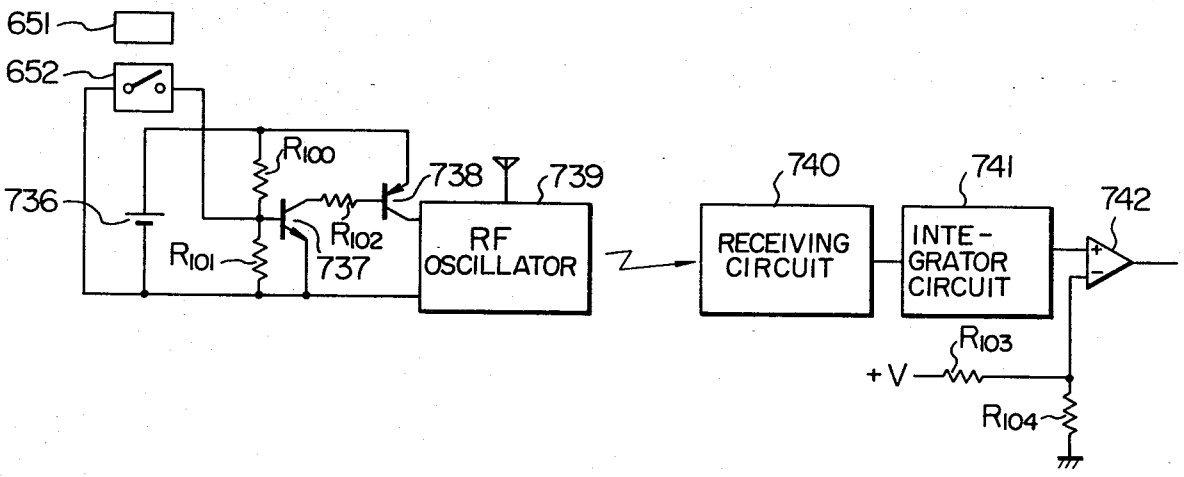
Figure 46:
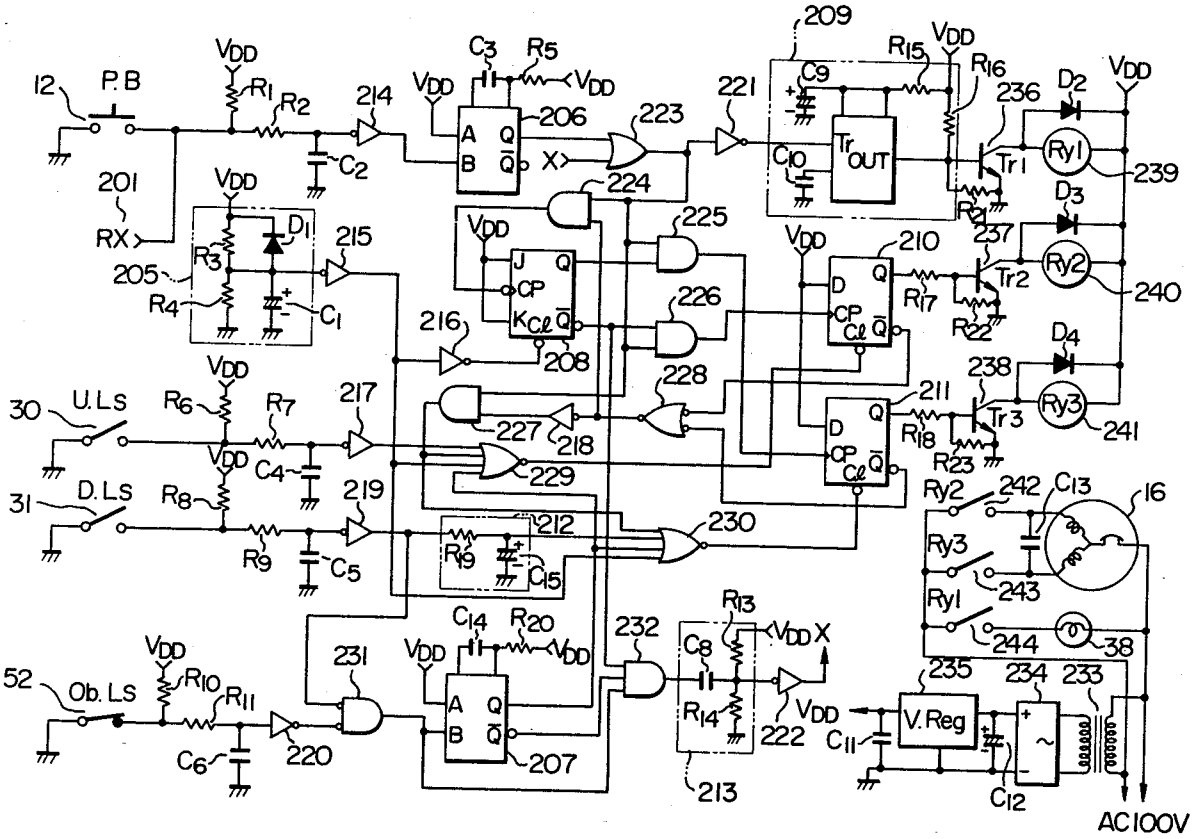
Figure 47:
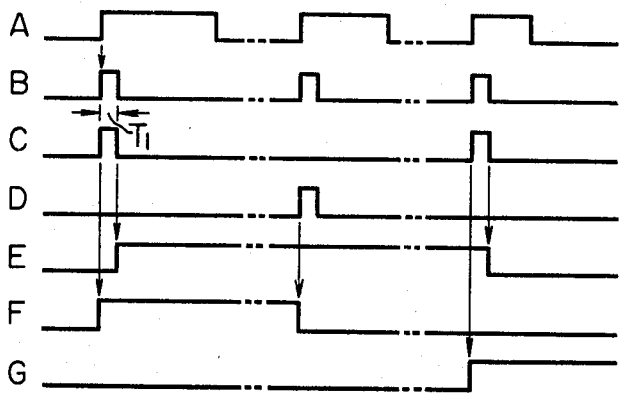
Figure 48:
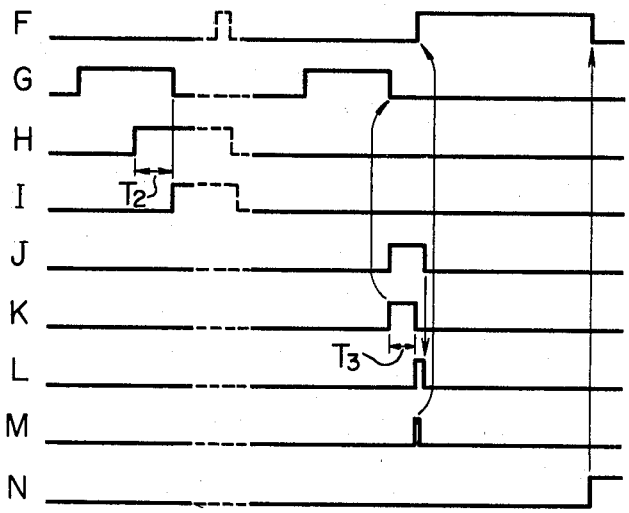

FIGS. 44*a* and 44*b* show constructions of the alarm;

FIG. 45 is a block diagram showing the connection of an abnormal condition detector and a control apparatus by use of an electric wave;

FIG. 46 is a circuit diagram showing another embodiment of the invention;

FIGS. 47 and 48 are timing charts; and

Figure 29:
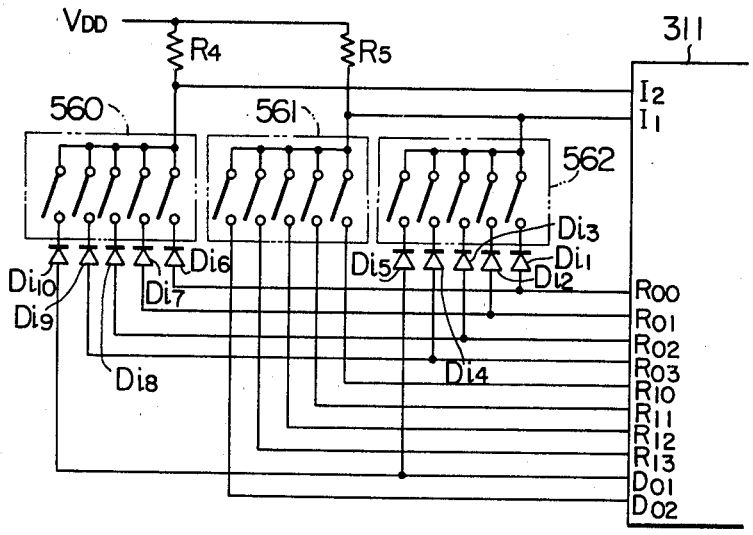
FIG. 29 shows a bit setting circuit.

FIG. 29 is a circuit diagram showing another embodiment.

Figure 1:
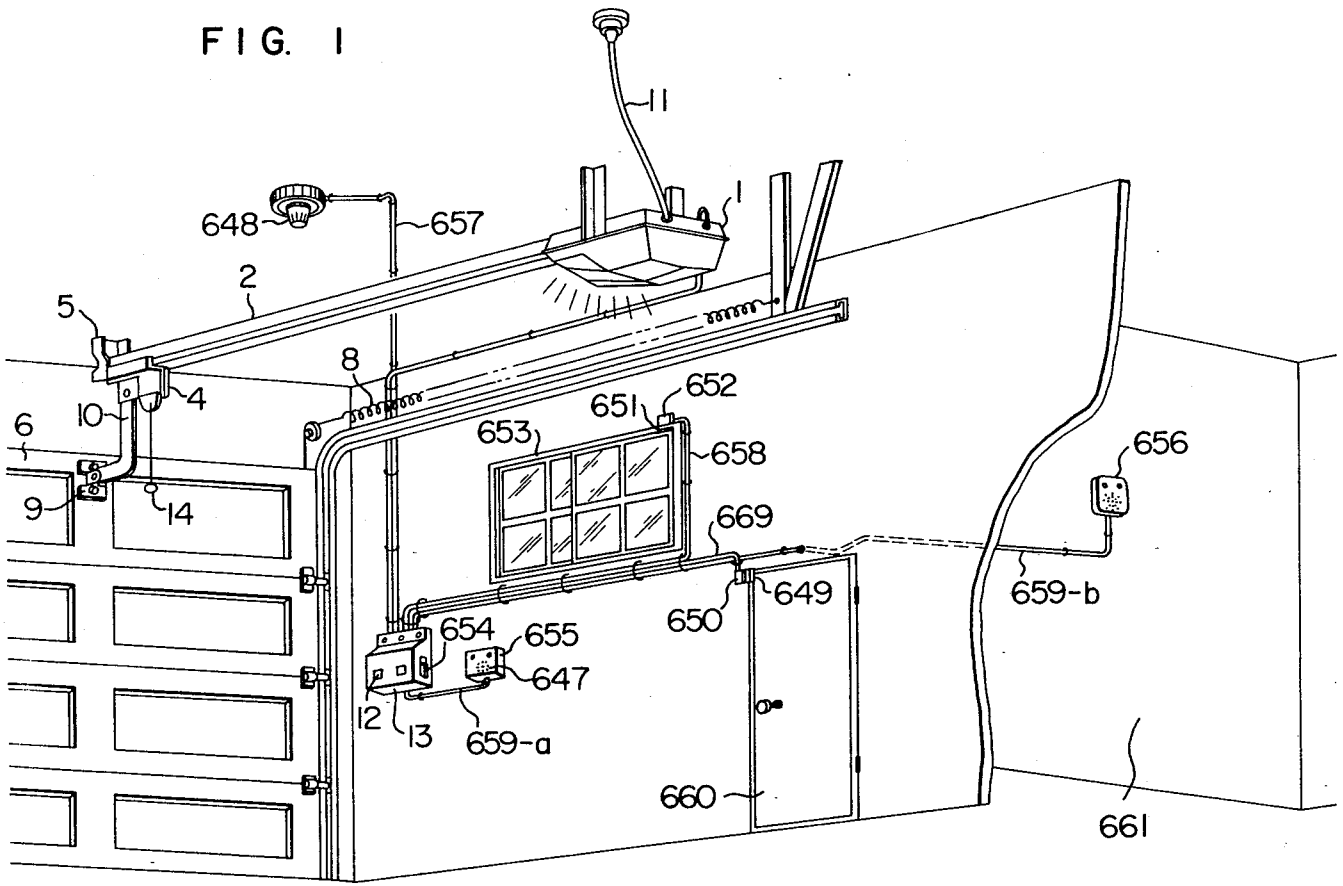
FIG. 1 is a diagram showing an arrangement of component parts.

As shown in FIG. 1, a garage door operating device according to the present invention comprises essential parts including a body 1 housing a driving mechanism, a rail 2 coupled with the body 1, and a trolley 4 guided by the rail 2 and adapted to be horizontally moved, the trolley 4 being secured to a roller chain actuated by the driving force of the body 1. The body 1 is hung from the ceiling of the garage by a hanger, and an end of the rail 2 is secured to part of the garage by a header bracket 5. A garage door 6, on the other hand, is generally divided into several parts coupled to each other and is opened and closed along door rail 7 on both sides thereof. The weight of the garage door 6 is balanced with a door balance spring 8 and is capable of being operated manually. A door basket 9 is secured to the garage door 6. The door bracket 9 is rotatably coupled to the trolley 4 through a door arm 10. Thus the garage door 6 is closed or opened along the door rail 7 in an interlocked relation with the roller chain 3 actuated by the driving force of the body 1 and the trolley 4 horizontally moved along the rail 2 by actuation of the roller chain 3. Power is supplied to the body 1 through a power cable 11.

A command for operating the body 1 is issued to the body 1 by depressing a push button switch 12 mounted on the wall of the garage or from a control 13 housing a receiver for receiving a signal in the form of electric wave or the like. Should the garage door operating device be rendered inoperative by a power failure or a like accident, a releasing string 14 decouples the roller chain 3 and the trolley 4, thus making the garage door 6 ready for manual operation.

Figure 2:
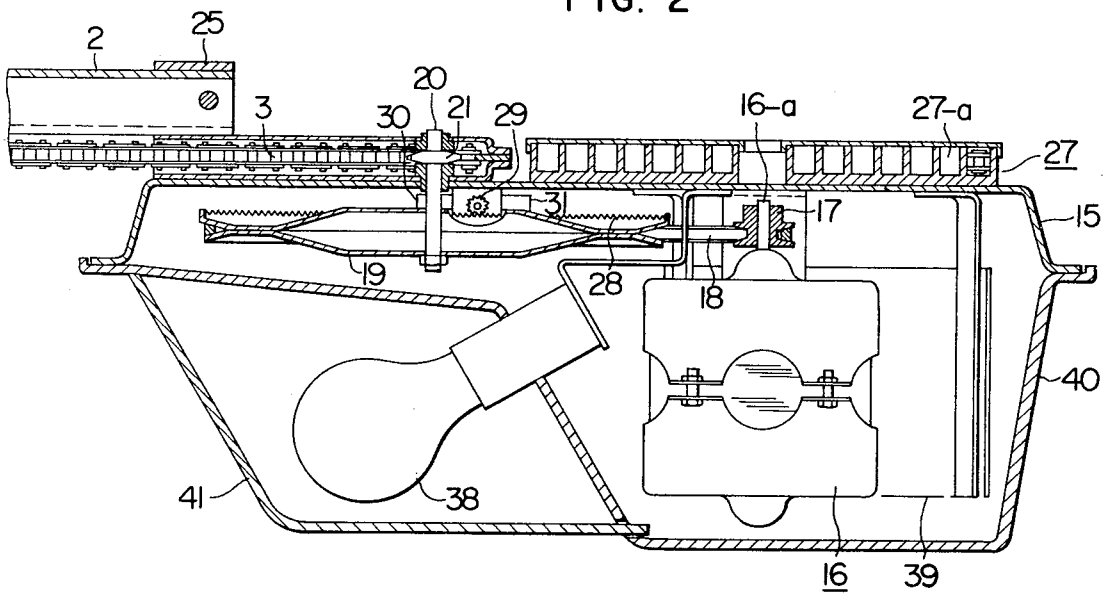
FIG. 2 is a longitudinal sectional view of a body of the door operating device.
Figure 3:
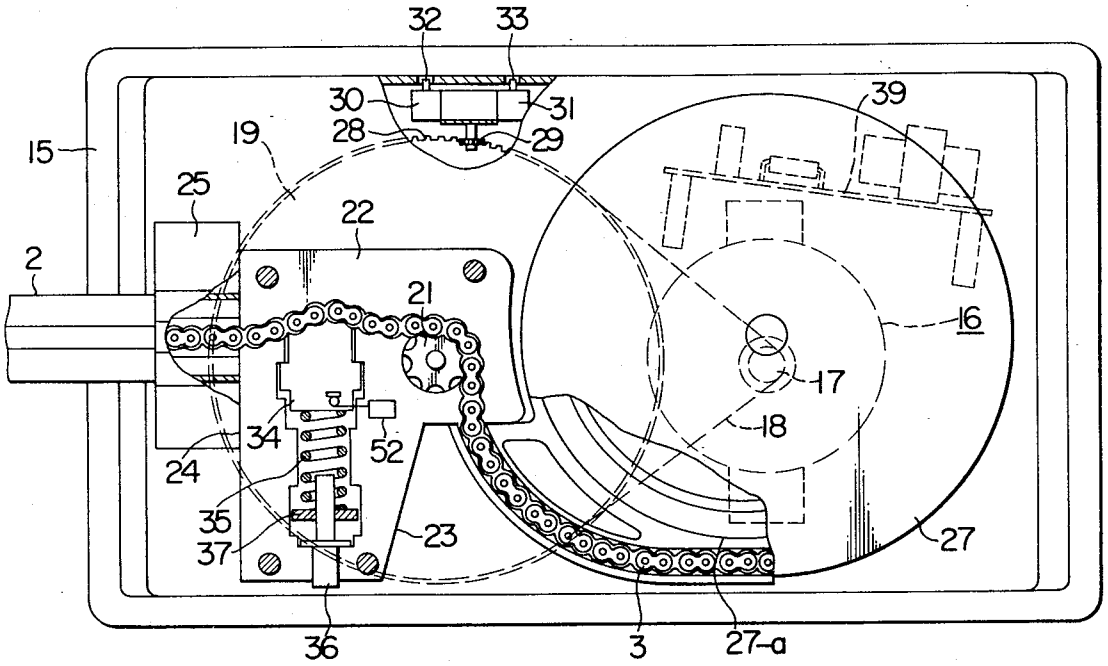
FIG. 3 is a plan view of the door operating device.

The construction of the body 1 of the garage door operating device will be explained with reference to FIGS. 2 and 3. FIG. 2 is a longitudinal sectional view and FIG. 3 a partially cut-away top plan view of the body 1.

The turning effort of a motor 16 secured to the lower side of the body frame 15 is transmitted to a motor pulley 17 secured to a motor shaft 16-*a*, a V-belt 18 and a large pulley 19. Further, the turning effort of the large pulley 19 is transmitted to a sprocket 21 through a sprocket shaft 20. The sprocket 21 is engaged with the roller chain 3. The rollers of the roller chain 3 are guided by a chain guide (A) 22, a chain guide (B) 23 and a chain guide (C) 24 from both sides thereof within the body 1. The rail 2 is secured to the frame 15 by a rail securing metal 25 without any difference in level or a gap with a groove formed by the chain guide (A) 22 and the chain guide (C) 24. The rollers of the roller chain 3 are guided on both sides thereof by the rail 2.

The roller chain 3 taken up by the sprocket 21 is contained in a chain containing groove 27-*a* of a chain containing case 27 secured without any difference in level or a gap with the groove formed by the chain guide (A) 22 and the chain guide (B) 23. In this construction, the rotation of the motor 16 rotates the sprocket 21, so that the roller chain 3 is reciprocated along the rail 2.

Next, a limit mechanism for limiting the horizontal movement of the trolley 4, i.e., the upper and lower limits of the operation of the garage door 6 explained with reference to FIG. 1 will be described. The amount of movement of the roller chain 3 is converted into the amount of movement of a pulley rack 28 provided on the outer periphery of the large pulley 19 rotated at the same rotational speed as the sprocket 21. The amount of movement of the pulley rack 28 is transmitted to an upper limit switch 30 and a lower limit switch 31 through a pinion 29 in mesh with the pulley rack 28. The upper limit switch 30 and the lower limit switch 31 have an upper limit adjusting knob 32 and a lower limit adjusting knob 33 respectively whereby the upper limit point and the lower limit point are freely adjustable from outside of the body.

In the case where the garage door encounters an obstruction during the downward motion thereof, it must be immediately detected and the door operation is required to be reversed, i.e., it must be moved upward for safety's sake. If the garage door strikes an obstruction during the upward motion thereof, on the other hand, it must be detected and the door must be stopped immediately for safety's sake. The above-mentioned obstruction detecting mechanism will be described below. Part of the chain guide groove formed by the chain guide (A) 22, the chain guide (B) 23 and the chain guide (C) 24 is curved. An obstruction detecting device 34 is provided which is driven by the compressive force applied to the roller chain by the downward door motion or the tensile force applied to the roller chain 3 by the upward door motion. The compressive force of the obstruction detecting spring 35 for limiting the operation of the obstruction detecting device 34 is capable of being freely changed by moving the spring holding plate 37 by turning the obstruction-exerted force adjusting screw 36. Also, by the operation of the obstruction detecting switch 52 which is turned on and off in response to the movement of the obstruction detecting device 34, such an obstruction as mentioned above is detected, so that the door is reversed into upward motion from downward motion, whereas it is stopped if it is in upward motion.

Figure 4:
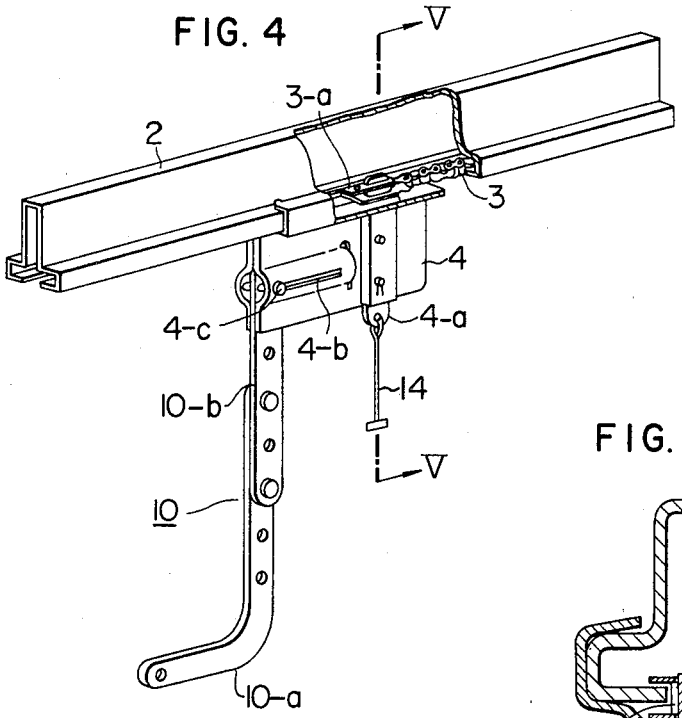
FIG. 4 is a perspective view of a rail and a trolley engaged with each other.
Figure 5:
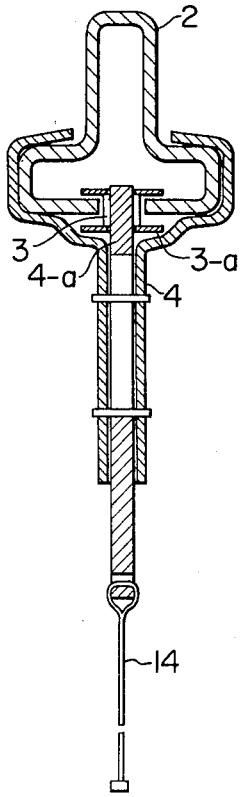
FIG. 5 is a sectional view taken in line V—V in FIG. 4.

A lamp 38 is for illuminating the inside of the garage, which lamp 38 is adapted to be turned on or off in response to the movement of the garage door. Further, a controller 39 for controlling the motor 16 and the lamp 38 is secured within the frame 15. A body cover 40 and a lamp cover 41 cover the motor 16, the large pulley 19 and the lamp 38. The lamp cover 41 is translucent and allows the light of the lamp 38 to pass therethrough, thus brightly illuminating the inside of the garage. The foregoing is the description of the construction of the body of the garage door operating device. Next, the rail and the trolley will be explained below with reference to FIGS. 4 and 5. The rail 2 is formed of a thin iron plate or a plastic plate and is used to slightly guide the trolley 4 along the outer periphery thereof. The rail 2 holds the rollers of the roller chain 3 from both sides thereof thereby to reciprocate the roller chain 3 in a straight line. Next, the trolley is coupled by inserting a pin 4-*c* into a slot 4-*b* formed in the trolley 4. The pin 4-*c* is normally pressed as shown in FIG. 4 by a spring or the like. This is to absorb a shock which will occur at the time of the door colliding with an obstruction while moving down. Also, it is necessary to take some action to prevent the garage door operating device from reversing by detection of an obstruction while the door is moving down, in response to a rise of the floor level by snow or ice or a small article such as a water hose. In other words, the door is required to stop but not to reverse upon detection of an obstruction in the range within 2 inches from the floor level. In this case, the difference in the amount of movement between the trolley 4 and the door 6 is absorbed by the slot 4-*b*.

Figure 6:
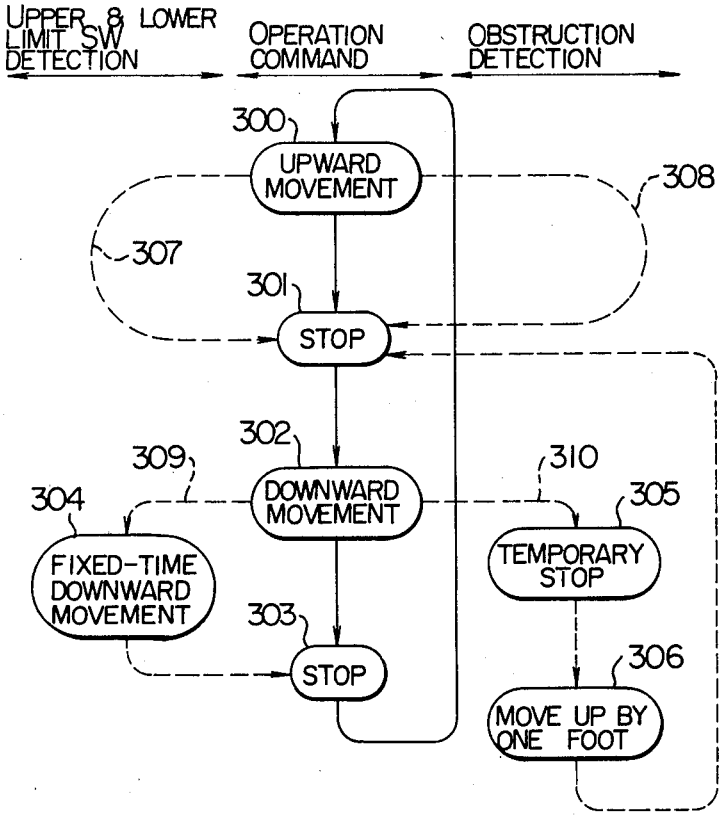
FIG. 6 is a flowchart of the basic operation of the apparatus according to the present invention.

The diagram of FIG. 6 shows a flow chart illustrating the sequence of the fundamental operations of the garage door. In FIG. 6, after power is thrown in, the garage door 6 is in the stationary state 303. In response to each operation command, the garage door 6 repeats the processes including the upward movement 300, stationary state 301, downward movment 302 and stationary state 303 in that order. Apart from these operating commands, the door 6 promptly transfers to the stationary state 301 through the state 307 when an input is applied from the upper limit switch 30 in response to the garage door 6 in the upward movement mode 300. When an input signal is applied from the lower limit switch 31 is response to the garage door 6 in downward movement 302, by contrast, the door 6 transfers to the fixed-time downward movement 304 through the state 309, and after the fixed time, it enters the stationary state 303. The reason for which the door moves down for the fixed time length will be explained later in detail.

Now, explanation will be made about the action to be taken when the movement of the garage door 6 is stopped to secure the safety thereof. In the case where an obstruction detection signal is applied while the garage door 6 is moving up, it promptly enters the stationary state 301 through the state 308. In the presence of an obstruction detection input during the downward movement of the garage door 6, on the other hand, the door transfers to the temporary stationary state 305 through the state 310, and after a fixed time length, transfers to the state 306 one foot higher. This one-foot rise is time controlled, so that after a predetermined length of time, the door transfers to the stationary state 301. Assuming that an input signal is applied from the upper limit switch 30 while the door is moving upward by one foot as mentioned above, however, the input from the upper limit switch 30 is given priority, so that the door 6 immediately transfers to the stationary state 301.

The reason for the downward movement for the fixed time length at 304 described above will be explained below. Generally, in winter season, the floor level under the door is liable to change due to the freezing or snowfall. If the floor level changes and rises from the initially-set level for the reasons mentioned above, the door moving down will always actuates the obstruction detection switch 52 and transfers to the state 310, thus making it impossible to close the door. For this reason, according to this embodiment, the lower limit switch 31 is actuated before the door 6 is closed up completely, so that the door is closed up after further downward movement for a predetermined length of time. In the presence of an input from the lower limit switch 31, the obstruction detection input is thus ignored. By doing so, proper door operation is not affected by any change in the floor level under the door. Further, this embodiment facilitates adjustment of the lower limit because it fully satisfied the provisions of U.S. Standards UL-325.27.1, thus remarkably improving the door operating efficiency.

More specifically, adjustment is made to actuate the lowerlimit switch 31 at the height of 2 inches from the floor level, so that the door 6 is completely closed up after the downward movement 304 for the fixed length of time. If the obstruction detection switch 52 is turned on during the fixed-time downward movement 304, action against the obstruction is given priority, so that the door 6 rapidly transfers to the stationary state 303. In this way, the pressing force against an obstruction present within two inches from the floor level is reduced.

The processes for controlling the garage door according to the present invention as mentioned above will be explained more in detail later with reference to the flow charts of FIGS. 14 to 37.

Figure 7:
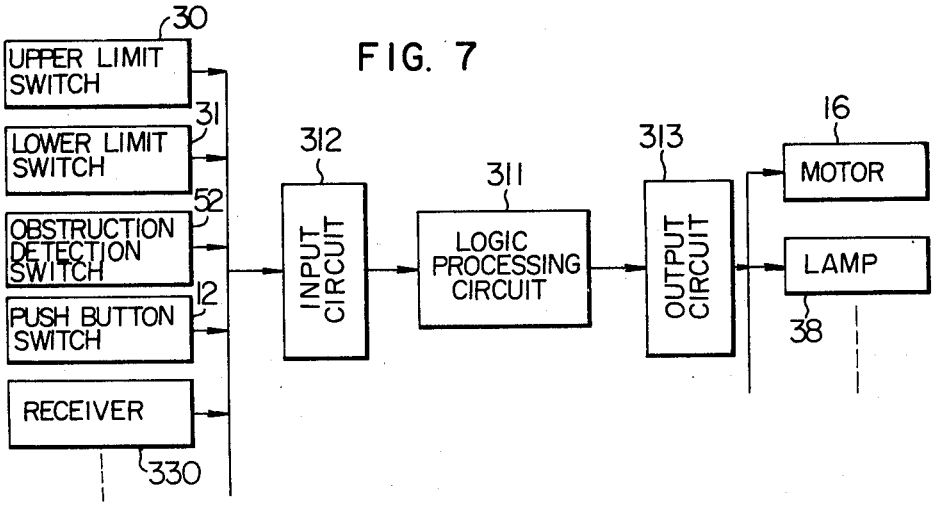
FIG. 7 is a basic block diagram showing a control section.

A basic block diagram of the control section is shown in FIG. 7. The control section basically comprises an input circuit 312, a logic processing circuit 311, and an output circuit 313. The input circuit 312 is an interface circuit having what is generally called a signal level conversion function, which circuit is impressed with signals representing the conditions of the garage door 6, from the upper limit switch 30, the lower limit switch 31, the obstruction detection switch 52 and a signal for operating the garage door 6 from the push button switch 12 or the receiver 330 for radio control. These signals are processed in optimum manner according to the processing steps stored in advance, and the resulting output is produced. This output signal is amplified by the output circuit 313, thereby subjecting the motor 16 to forward-reverse control and the in-garage illumination lamp 38 to on-off control.

Figure 8:
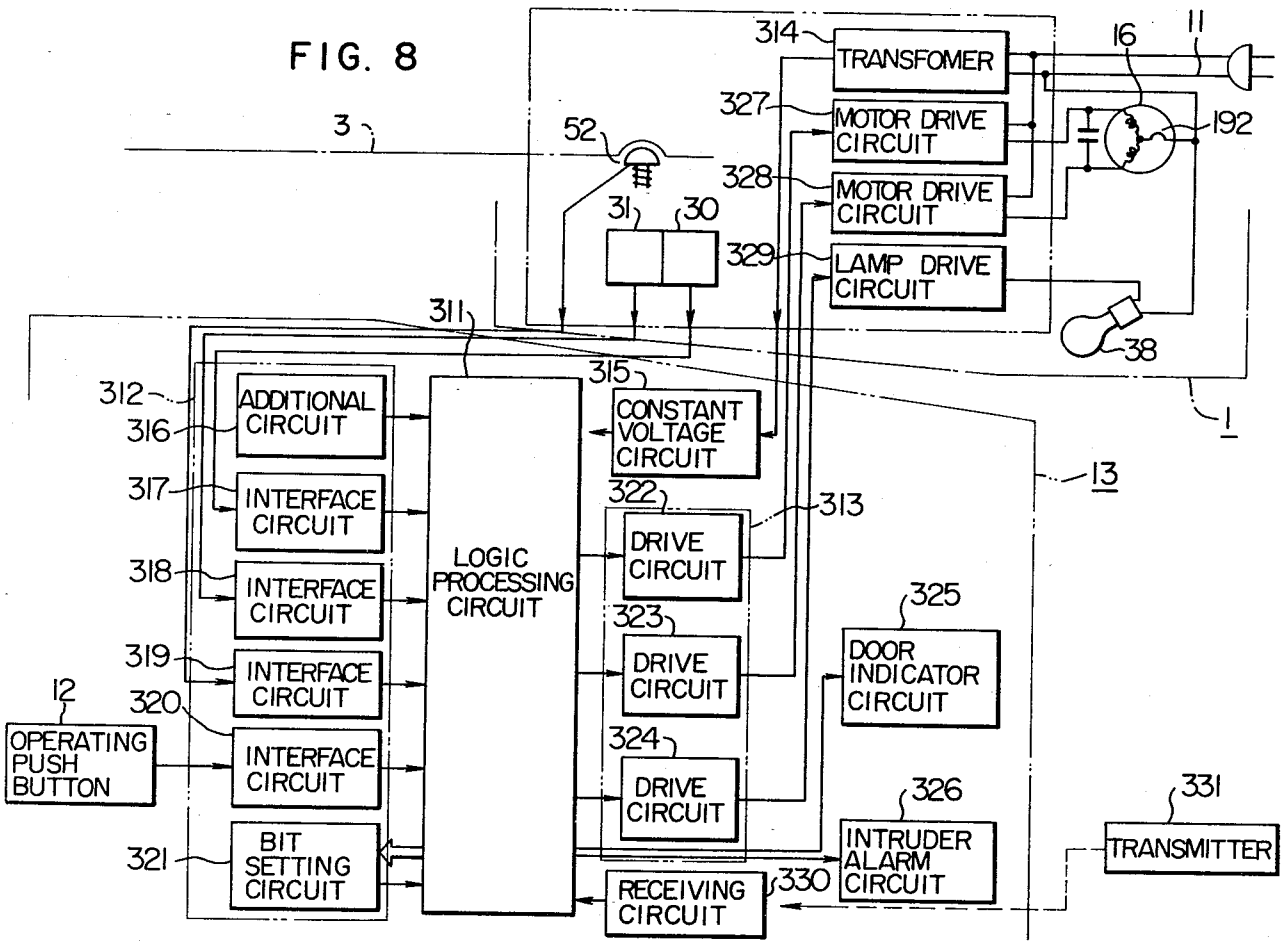
FIG. 8 is a block diagram showing the detail of the same control section.

An embodiment representing the basic block diagram of FIG. 7 is shown in FIG. 8.

According to the present embodiment, the control device 13 containing the receiver also contains all the signal processing parts primarily including the logic processing circuit 311. The body 1 includes a driving section and an illuminating section comprised of the motor 16 and the lamp 38 respectively, and a driver circuit for driving them, or more specifically, motor drive circuits 327, 328 comprised of a relay and a transformer 314, and a lamp drive circuit 329 comprised of a relay. The control device 13 is connected to the body 1 by way of eight wires.

The primary source voltage of 115 V supplied by the power cord 11 is reduced to AC 14 V by the transformer 314, and converted into a constant voltage to DC 10 V by the constant voltage circuit 315. The outputs of the upper limit switch 30, the lower limit switch 31 and the obstruction detection switch 52 are applied to the interface circuits 317, 318 and 319 including resistors and capacitors, the outputs of which are in turn applied to the logic processing circuit 311 respectively.

The output signal from the operating push button switch 12 is applied to the interface circuit 320 including a resistor and a capacitor, the output of which is applied to the logic processing circuit 311. The output of the logic processing circuit 311 is applied to the drive circuit 322 including a transistor, thereby driving the drive circuit 327 including a relay for driving the motor 16 forwardly. The drive circuit 322 including a transistor, in turn, is impressed with the output of the logic processing circuit 311, thereby driving the drive circuit 328 including a relay for reversely driving the motor 16. As a drive circuit for turning on and off the lamp 38, the drive circuit 329 including a relay is driven by the logic processing circuit 311 through the drive circuit 324 including a transistor for driving the relay of the drive circuit 329.

A door indicator circuit 325 for indicating the conditions of the garage door 6 and an intruder preventing alarm circuit 326 which are included in the output circuits of the logic processing circuit 311 will be explained in detail later.

The push button switch 12 is a door operating switch mounted on the case of the control device 13, apart from which there is provided a radio control operating command system utilizing the transmission-receiving functions. This is for operating the door from a position distant from the garage and used an electric wave of UHF band. For operation, first, the bit setting section contained in the transmitter 331 and the bit setting circuit 321 within the control device 13 are set appropriately. The data supplied sequentially from the transmitter 331 include bit data thus set. The format of the data will be explained later in detail. The data thus supplied are modulated and converted into a binary number signal at the receiving circuit 330 and applied to the logic processing circuit 311. The receiving circuit used in this case mainly comprises a super-regeneration circuit. The date supplied are compared with the data stored in the bit setting circuit 321 sequentially, and only when all the bits are coincident, they are processed as an operating signal. Naturally, if bits are set improperly, the garage door is incapable of being operated.

In addition, there is provided an additional circuit 316 having the function to set the on time of the lamp 38 and receiving a signal obtained by detecting an abnormal condition within a garage.

Figure 9:
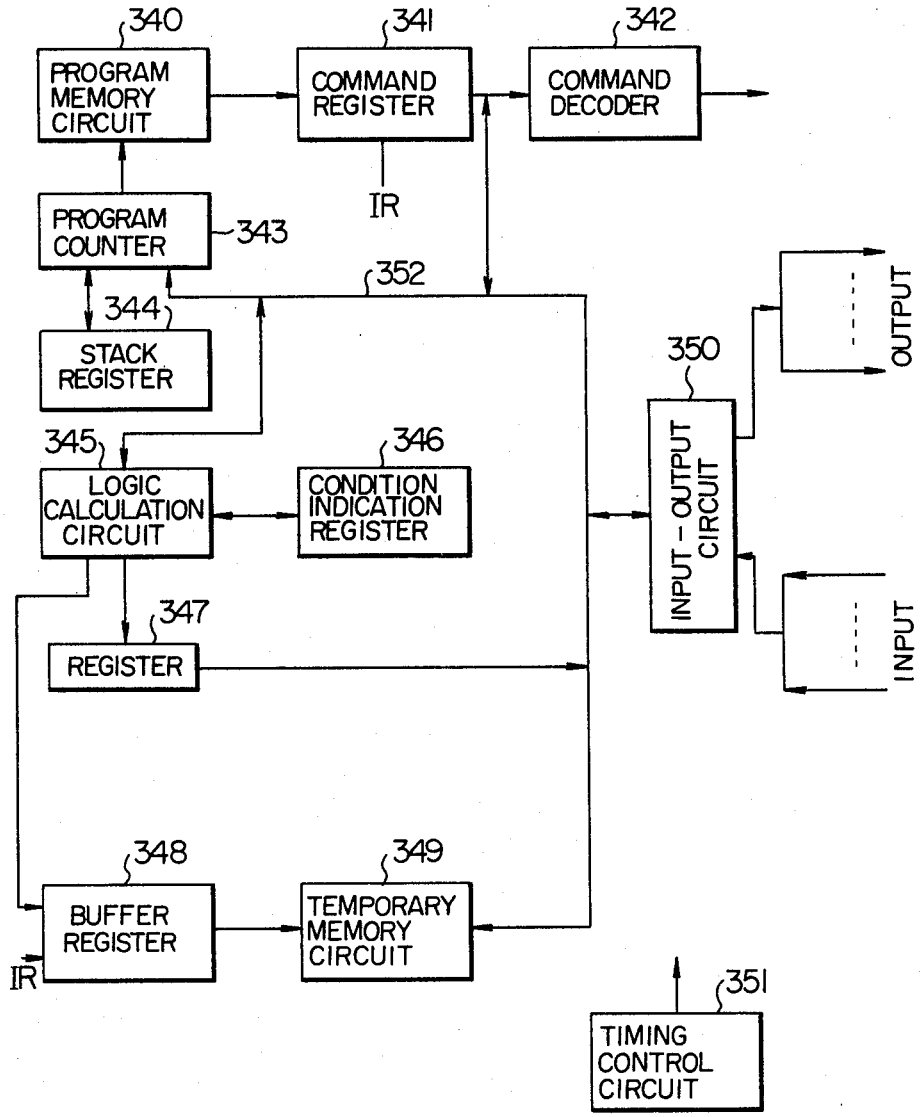
FIG. 9 is a diagram showing a logic processing circuit.

Next, the configuration of the logic processing circuit 311 will be explained with reference to FIG. 9. In order to control the garage door in optimum manner, the circuit 311 comprises a program memory circuit 340 (which in this case is a read-only memory (ROM)) for storing programmed data on the processing sequence in advance, a command register 341 for temporarily storing a command code read out of the program memory circuit 340, and a command decoder 342 for decoding the command code stored in the command register 341. The entire circuits are operated in response to a timing pulse produced from the timing control circuit 351 for controlling the operation timing of the entire circuits and the command code. A program counter 343 is provided for designating and updating an address of the command code for the program memory circuit 340. The program counter 343 is connected with a stack register 344 used for storing the return address in the case of a skip such as a subroutine jump.

Further, the circuit 311 comprises a logic calculation circuit 345 for logic operation, a condition indication register 346 for temporarily storing the result of the logic calculation, a register 347 such as an accumulator used for logic calculation, and temporary memory circuit 349 (which employs a random access memory (RAM)) for storing the result of logic operation or a status flag such as the present condition of the garage door ("1" in operation, and "0" in stoppage). A buffer register 348 is addressed by the logic calculation circuit 345, and the main circuits are connected by a bus line 352. The bus line 352 is also connected with the input-outut circuit 350, so that the input-output condition applied through the bus line 352 is processed by logic decision means including the logic calculation circuit 345, the register 347 and the condition indication register 346.

Figure 10:
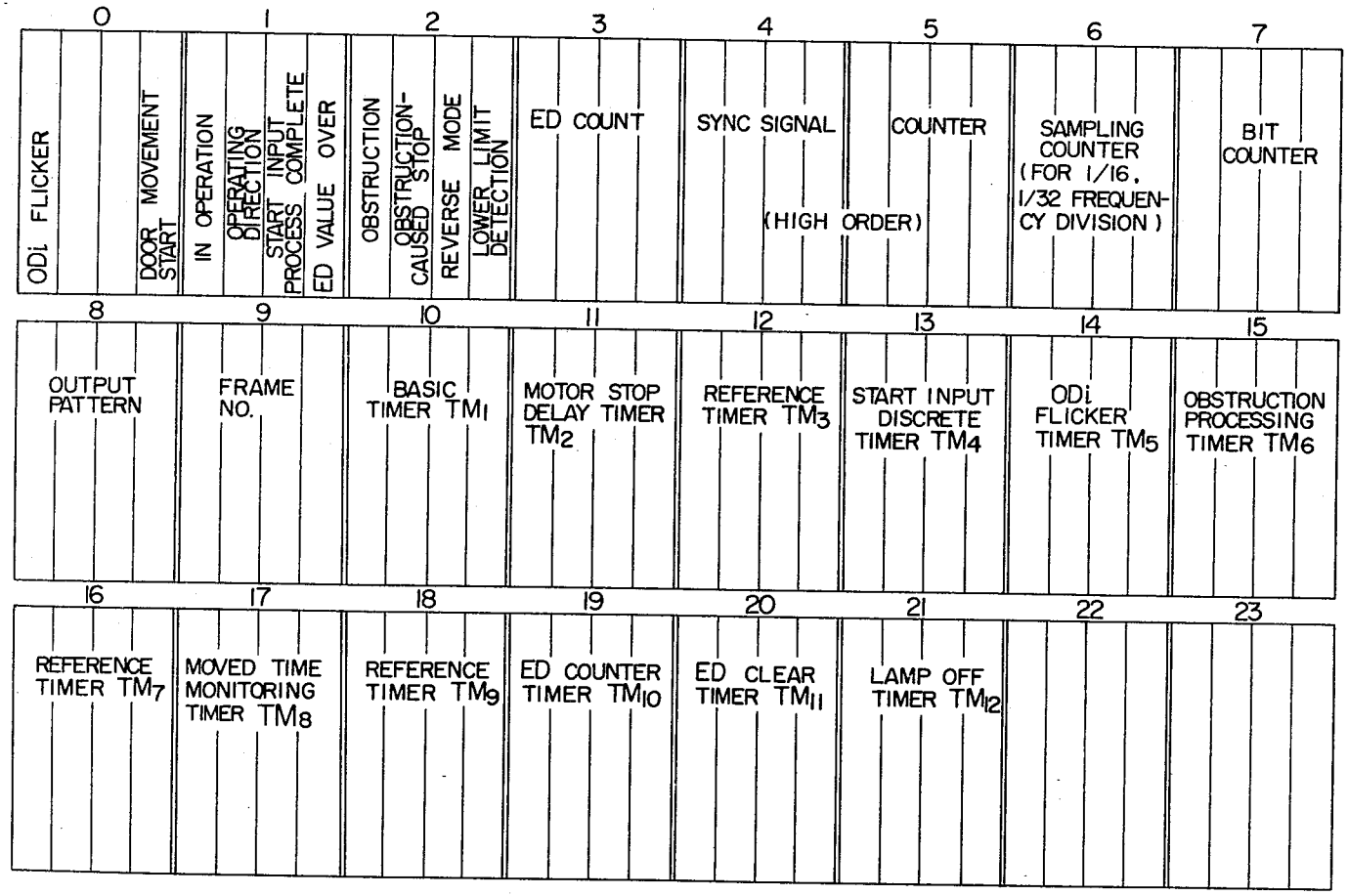
FIG. 10 is a diagram showing a storage pattern of a temporary memory circuit.

The temporary memory circuit 349 which plays an especially important role in the above-mentioned processing in this circuit configuration will be described below with reference to FIG. 10.

As explained above, the temporary memory circuit 349 is used for temporary storage of the result of calculation or condition flags in units of 4-bit 2-byte. The embodiment under consideration has a map area of 22 bytes. These condition flags are assigned with three bytes of 0, 1 and 2. The individual flags will be defined later with reference to the attached flow charts.

The 12 bytes from 10 to 21 are used as timer elements. A basic timer $TM_1$ makes up the essence of all the timers, which timer operates at 15.625 m sec in this embodiment. This figure is obtained by counting a predetermined number of steps in view of the fact that the time required for the processing step for each program is known in advance. In other words, the embodiment under consideration of this invention uses no timer system which is comprised of external hardware.

These condition flags and timers are updated sequentially in accordance with their processing steps, so that the resulting data and the command codes stored in the program memory circuit are used for logic decision at the logic calculation circuit 345, thus determining an optimum program processing.

Next, the sequence of operation of the garage door according to the present invention will be explained specifically.

The operation sequence of the garage door is already explained with reference to FIG. 6. Before referring to the flow charts, items to which special attention shall be paid will be described in connection with the date to be processed.

1. Discrete input signal control

This is for discrimination whether the input signal from the operating push button switch or the receiver is a new signal or a continued signal. As one method for this discrimination, the timer $TM_4$ is set after the input signal is turned off, so that if an input signal is applied anew before the time over, it is determined as a continued signal, while if the next signal is applied after the time over, it is processed as a new input signal. In the case of the signal applied before time over, the timer $TM_4$ is set anew after that signal is turned off. Further, the embodiment of the present invention under consideration has the following additional features to improve the operating efficiency thereof:

(1) When the door begins to operate, a condition where it is desired to stop the door may occur, such as when an obstruction is present in the way of the door. To meet such a situation, the value of 0.25 seconds is employed for the discrete timer $TM_4$ for the door in operation.

(2) When restarting the door after it has stopped, it is necessary to provide a sufficient length of door stoppage time in order to reduce any great shock load which otherwise might be exerted on the driving section or the door. Our experiments confirmed that the rotational inertia of the motor completely disappears within about 0.25 seconds, and as a result the value of 0.5 seconds is employed for the discrete timer $TM_4$ in stationary state.

2. Number-of-starts control

Figure 11:
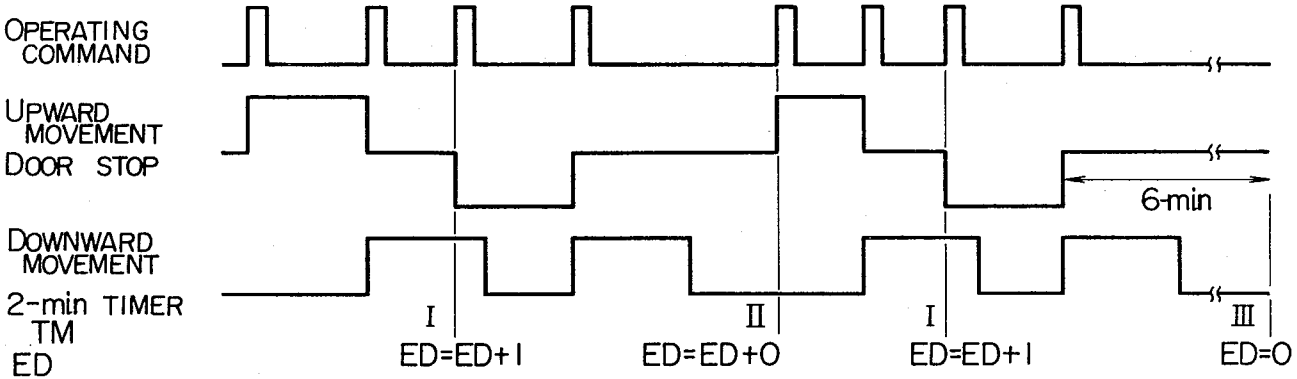
FIG. 11 is a time chart for explaining the control of the number of starts.

The motor used for the garage door is generally rated for a short time, and if it is operated continuously in repetitive fashion, the thermal switch 192 for the motor is actuated. As a result, unless the motor housing is cooled, the thermal switch 192 is not restored, thus rendering the garage door inoperative for about 20 minutes. Such a situation is not likely to occur under normal operating conditions but may be caused by mischief of children in most cases. Especially when children's mischief causes very frequent actuations of the thermal switch 192, the motor life is shortened undesirably on the one hand and a serious accident may occur on the other hand. As one method for preventing such an unfavorable situation, a number-of-starts control algorithm as shown in FIG. 11 is employed in this embodiment.

(1) The timer $TM_{10}$ is set at 2 minutes after the door has stopped.

(2) If a restart operating command is applied before time over of the timer $TM_{10}$ such as in condition I, the ED counter i.e., the number-of-starts counter is stepped forward.

(3) In the event that a restart operating command is applied after time over of the timer $TM_{10}$ such as in the condition II, the ED counter is kept in the same state.

(4) If a restart operating command fails to be applied within six minutes following door stoppage such as in the condition III, the ED counter is cleared. The timer $TM_{11}$ is used for this purpose.

(5) If the ED counter reaches the value 12 after the processes (2), (3) and (4) above, any operating command is rejected for subsequent six minutes. Thus the door is rendered operable again six minutes after.

3. Open door indicator (hereinafter sometimes referred to as ODi)

Figure 12:
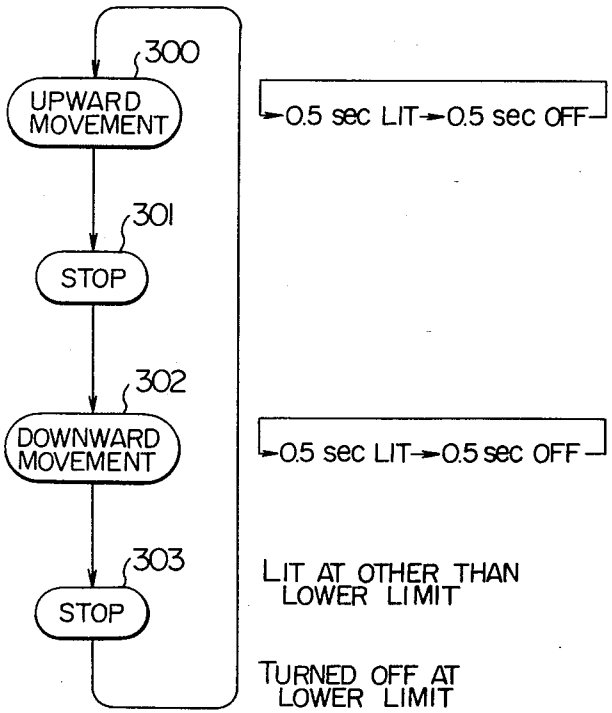
FIG. 12 is a flowchart showing the operation of a door indicator.

This is for indicating the condition of the garage door shown in FIG. 1 and comprises such specific elements as a lamp and a door indicator circuit 325 for turning on and off a light-emitting diode. An example of the light-emitting diode turned on and off is shown in FIG. 12.

4. Double safety control

In the case where the upper limit switch 30 or the lower limit switch 31 for setting the door motion range gets out of order, the door runs against the floor if going down or runs against the upper stopper if going up, thus actuating the obstruction switch 52. If the obstruction switch 52 is out of order, however, the door continues to be pressed against the obstruction strongly until the motor generates a lock torque and turns on the thermal switch 192. This condition is not desirable for safety and must be prevented in the manner mentioned below. In view of the fact that the distance covered by the door is limited to, say, 9 feet or 2.7 m, the time required for coverage is naturally limited. For instance, if the door runs at the speed of 10 m/min., the time required $T_T$ is 16 seconds (2.7 divided by 10, and the resulting minutes converted into seconds). In the event that with the timer $TM_8$ set after starting the operation of the door, the upper limit, lower limit or obstruction signal fails to be applied before time over of the timer $TM_8$, the condition is judged as abnormal and the obstruction detecting processing function is performed. This function is effective to secure safety in that the motor is stopped within a predetermined time in the case where, for instance, the door fails to operate due to a fault of part of the driving system or specifically, the turning effort is not transmitted due to a belt slip which heats the belt and the belt is liable to be broken.

5. Obstruction ignoring control

Generally, the friction is divided into static and dynamic frictions, the former being greater than the latter. This is also the case with the door garage. At the time of starting the operation of the garage door, for instance, a great force is required, although during the door operation, so great a power is not required. In order for the obstruction detection switch 52 to fail to be actuated at the time of door operation start, an operation setting value must be made great, with the result that the ability to detect an obstruction against the door in operation represents a great value. This contradicts the small power for obstruction detection which is required for high door operating efficiency and safety. To overcome this problem, this embodiment of the invention is such that the obstruction detection is ignored for a predetermined length of time, or one second in this case after starting the door operation. This is based on the assumption that every door remains in adequately steady operation at least for one second after start.

6. Upper-lower limit switch control

It is normally impossible that the upper limit switch and the lower limit switch are actuated at the same time. In abnormal cases, however, such a condition may occur. The contacts of the upper limit switch 30 may be in fusion-closed when the lower limit switch 31 is on as the door is at the lowest position, or part of the wiring may be broken and come into contact with the chassis. By contrast, when the door is at the uppermost position and the upper limit switch 30 is on, the contacts of the lower limit switch 31 may be closed by fusion or part of the wiring may be broken and in contact with the chassis. In still another case, the wiring may be broken or the contact may be broken for both the upper and lower limit switches at the same time. In such a case, the door is kept stationary in spite of application of an operating input signal or regardless of the simultaneous application of the limit switch signals.

7. Lamp-lit time control

The additional circuit 316 shown in FIG. 8 is adapted to set the lamp-lit time at two or six minutes. According to the embodiment of the invention under consideration, the lamp is lit upon starting the door operation, and after the door has stopped, the timer $TM_{12}$ is set as predetermined, so that the lamp may be extinguished by time over of the same timer $TM_{12}$.

8. Received signal control

Figure 13:
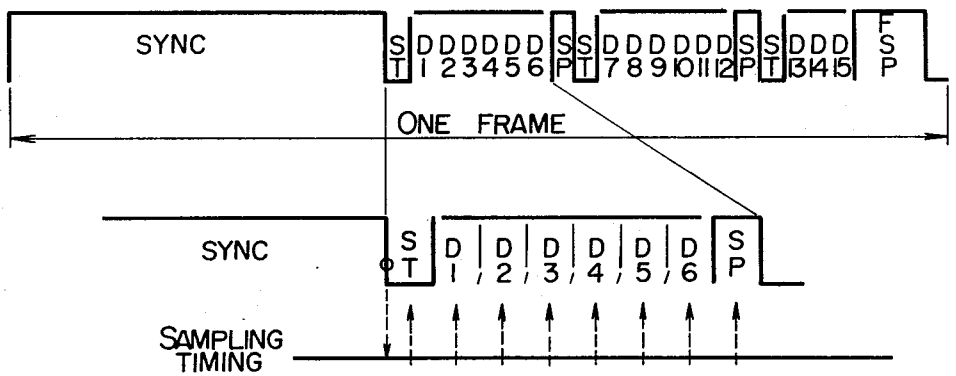
FIG. 13 shows a transmission-receipt data format.

The signal transmitted from a radio control transmitter is demodulated into a binary number by the receiving circuit 330 and applied to the logic processing circuit 311. A format of such an input signal is shown in FIG. 13. For the purpose of classification in the communications field, this format belongs to NRZ (Non return zero) the specification of which will be described below.

(1) The synchronizing signal SYNC has 16 bits. The length of this synchronizing signal SYNC is counted, and if it is within a predetermined range, the signal is processed as a synchronizing signal. First, the length of the synchronizing signal is taken as 1/16, and thus a sampling period is determined.

(2) The sampling is started from the fall of the synchronizing signal SYNC. Only for the start bit ST, however, the sampling length is set at 1/32. The start bit is kept always "0".

(3) After sampling check of the data of 6 bits, it is confirmed that the stop bit SP is "1". From the fall of this stop bit SP, the next sampling is started. By doing so, the sampling error accumulation can be retained in eight bits.

(4) After completion of the checking "1110" of the frame stop bit FSP, the signal is processed as an operating signal.

Figure 14:
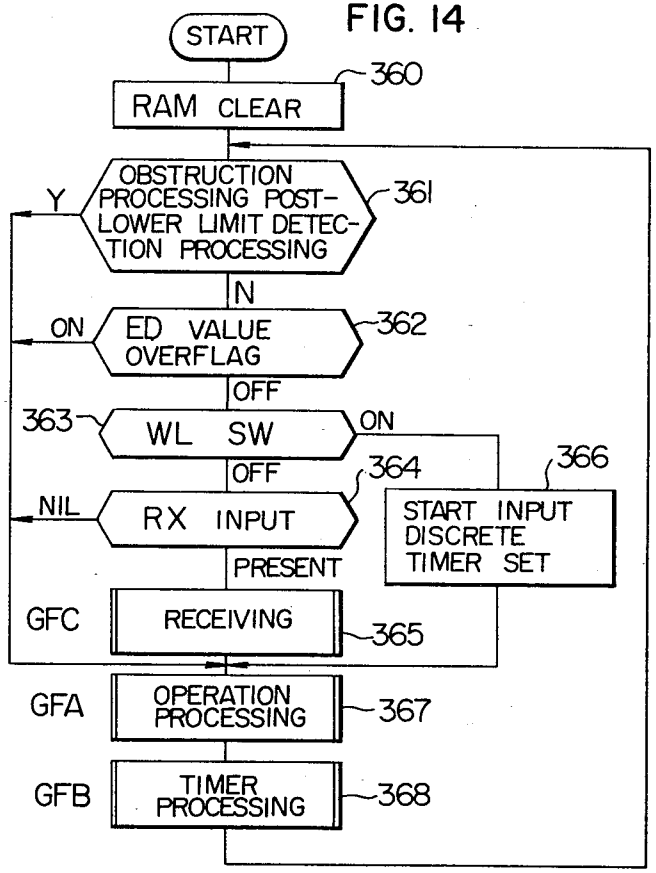
FIGS. 14 to 27 are flowcharts showing various operations.

The main flow chart according to the present invention is shown in FIG. 14. The processing steps are started after power is thrown in. First, the RAM clear step 360 is taken in order to set the temporary memory circuit 349 at initial condition. Next, the obstruction processing and post-lower limit detection processing 361 is checked. The obstruction processing represents the condition 310 in FIG. 6, and the post-lower limit detection processing represents the condition 309. During these processes, the door is inoperable by either the push button switch or the transmission-receiving. While these processes are not going on, the ED (number of starts) value overflag 362 is checked, and if the flag is "1", the door is also inoperative by the push button switch or the transmission-receipt. If the flag is "0", the on-off of the push button switch (hereinafter referred to as WL SW) is checked. When WL SW 363 is on, the start input discrete timer set 366 is taken. If WL SW 363 is off, in contrast, the receipt (hereinafter be referred to as Rx) which may input 364 is checked, and if it is at "1" level, transfer is made to the next receipt processing step 365. Then, through the operation processing 367 and the timer processing 368, the obstruction processing and the post-lower limit detection processing 361 is resorted to again, thus forming one cycle.

In this main flow chart, the operation process 367 will be explained below with reference to FIGS. 15 to 23.

Figure 15:
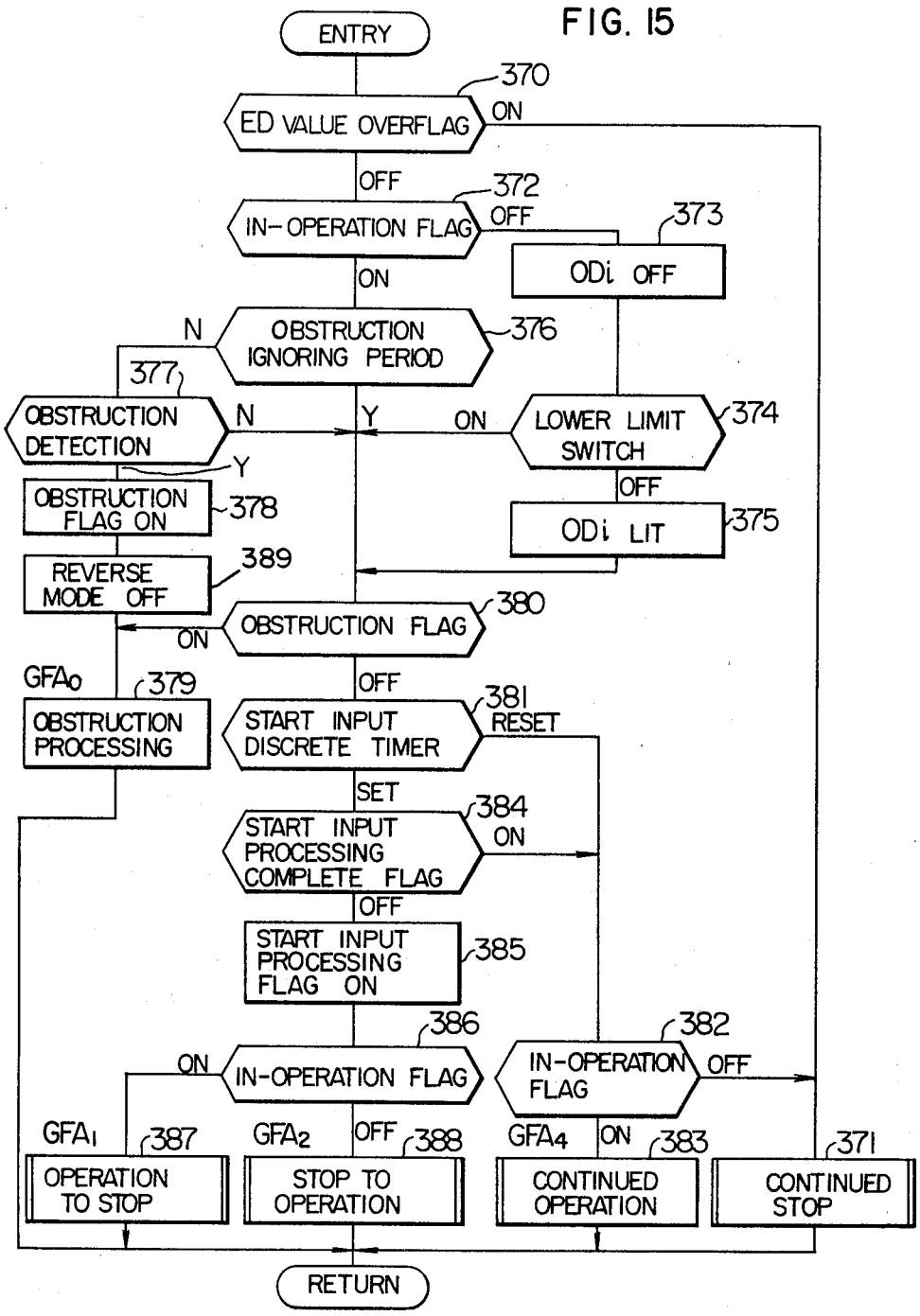

The main flow chart for operation processing is shown in FIG. 15. The ED value overflag 370 is checked. As explained with reference to FIG. 11, this ED value overflag 370 is raised when excessively frequent starts are detected during a limited time. In the case of flag on, the continued stop processing 371 is taken, so that the operating mode is in stoppage. When the flag is off, on the other hand, the in-operation flag 372 is checked. When the in-operation flag is off, it means stoppage so that the open door indicator circuit 325 (hereinafter referred to as ODi) for indicating the door condition is temporarily turned off. After the step 373 of turning off ODi, the lower limit SW 374 is checked to see whether or not the door is located at the lower limit switch. If the lower limit SW 374 is off, the ODi turn on 375 is taken, while if 374 is on, the ODi 325 is kept off. By this process, the stationary condition 301 or condition 303 shown in FIG. 12 is indicated.

If the in-operation flag 372 is on, the obstruction ignoring period 376 is checked. This corresponds to the time of the timer $TM_6$ in the temporary memory circuit. The value of the timer $TM_6$ is checked, and if it is not a set value, one second has not yet passed after door start, so that the obstruction input is ignored. The reason for providing the obstruction ignoring period 376 is explained above and will not be referred to again.

If it is not in the obstruction ignoring period, the door in steady movement is indicated, and the obstruction detection 377 is checked to determine the presence or absence of an obstruction. If an obstruction signal is applied, the obstruction processing 379 is taken after the obstruction flag on 378 and the reverse mode off 389 processing.

In the obstruction ignoring period 376, it is determined whether the obstruction flag 380 is on or off. In the case of the obstruction flag on, the obstruction is being processed and the obstruction processing step 379 is taken. If the obstruction flag is off, by contrast, it is determined whether the start input discrete timer 381 is set or reset. This corresponds to the timer $TM_4$ in the temporary memory circuit. The timer $TM_4$ is set at 0.25 seconds when the door is in operation and at 0.5 seconds when the door is stationary. That the timer $TM_4$ is reset is indicative of the fact that no operating signal is applied, and it is necessary to continue the same door condition. Thus the in-operation flag 382 is checked, and if this flag is on, the door is in operation, so that the continued operation processing step 383 is taken, while if the same flag is off, the continued stoppage processing step 371 is taken.

When the start input discrete timer 381 is set, the start input process complete flag 384 is checked. In other words, it is determined whether quite a new operating signal or a signal once processed in involved. If the flag 384 is on, the same door condition is required to be continued, and a jump is made to the step for checking the in-operation flag 382.

In the case where the start input complete flag is off, the start input complete flag on 385 is taken, followed by the checking of the in-operation flag 386. If this flag is on, on the other hand, the door is in operation and is required to be stopped. For this purpose, steps are taken from operation to stop 387.

In the case where the in-operation flag 386 is off, by contrast, the door is stationary and is required to be started. For this purpose, steps are taken from the stop to operation 388.

Figure 16:
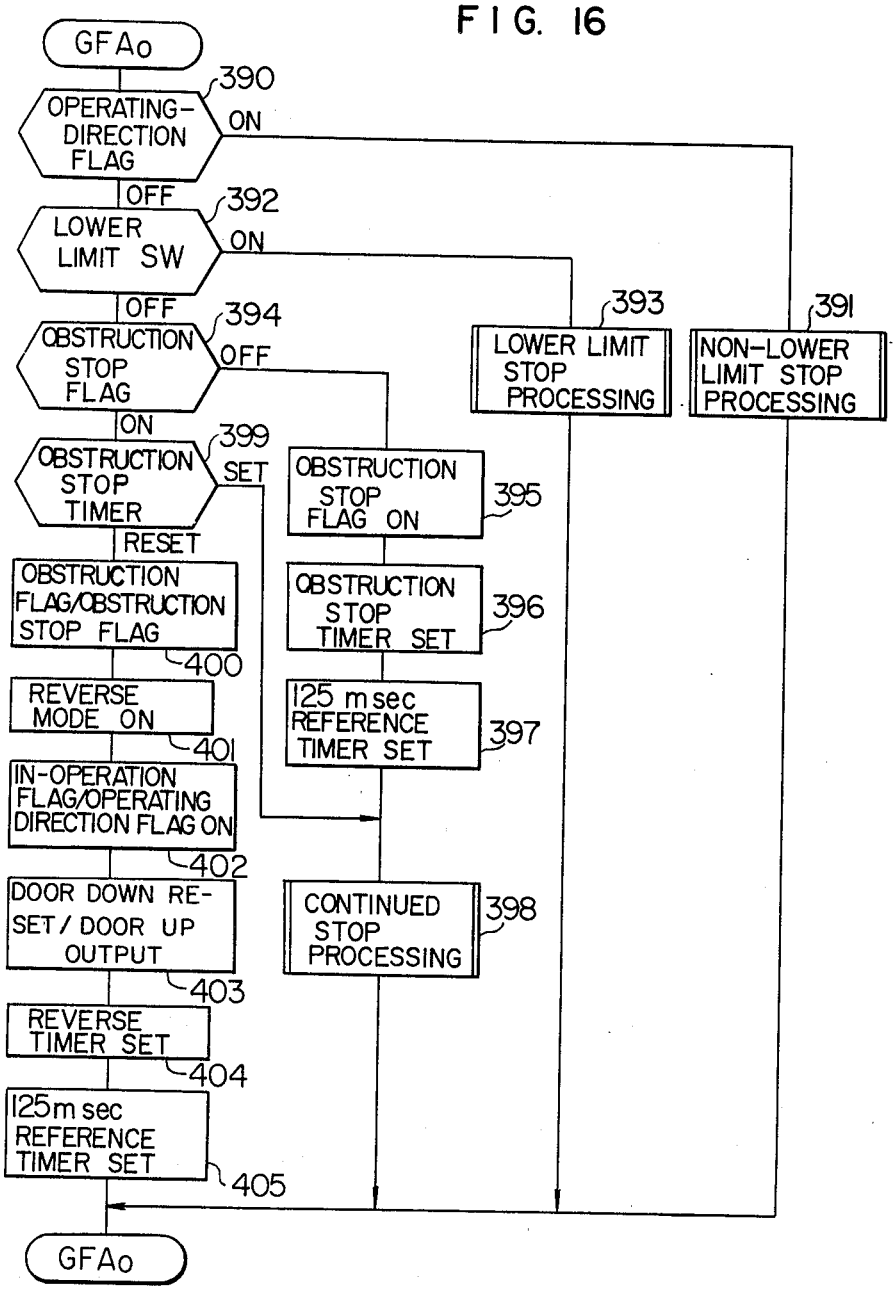

Next, the obstruction processing step 379 will be explained with reference to FIG. 16. This process includes the conditions 308, 309 and 310 shown in FIG. 6. The condition 309, however, concerns the obstruction detected during the fixed-time downward movement.

If it is found that the operating direction flag 390 is on as a result of checking the same, it means an upward movement and therefore the non-lower limit stop processing step 391 is taken for stopping the door. If the flag 390 is off, it means a downward movement, and therefore the lower limit SW 392 is checked. If the lower limit SW 392 is on, the condition 309 is involved, so that there is no need for reversing but the lower limit stop processing step 393 is taken.

In the case where the lower limit SW 392 is off, the reverse upward movement is required. Next, if the checking of the obstruction stationary flag 394 shows that it is off, the obstruction processing step 305 is required to be taken. In other words, the obstruction stationary flag on 395, the obstruction stop timer set 396 (corresponding to the timer $TM_6$ in FIG. 10), the 125 msec reference timer set 397 (corresponding to the timer $TM_3$ in FIG. 10), and the continued stop processing step 398 are taken.

In the case where the obstruction stationary flag is on, the obstruction stationary timer 399 is checked, and the door is required to be kept stationary until it is reset. The set time is 0.5 seconds in the present embodiment of the invention.

Assume that the stop timer 399 is reset. In order to realize the condition 306 in FIG. 6, the obstruction flag/obstruction stop flag off 400, the reverse mode on 401, the in-operation/operating direction flag 402, the motor downward movement reset/motor upward movement output 403, the reverse timer set 404 (corresponding to the timer $TM_6$ in FIG. 10), and the 125 msec reference timer set 405 (corresponding to the timer $TM_3$ in FIG. 10) are taken.

Figure 17:
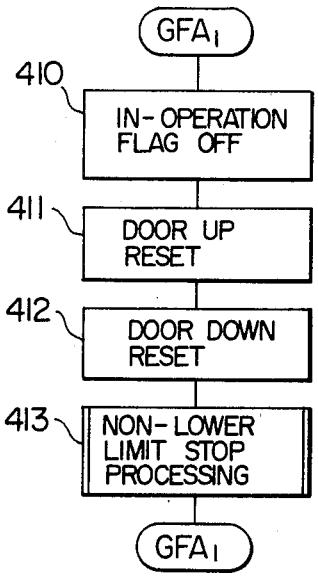

Next, the operation-to-stop processing step 387 will be explained with reference to FIG. 17.

As a process for stoppage, the in-operation flag off 410, the door upward movement reset 411, the door downward movement 412 and the non-lower limit stop processing step 413 are taken.

Figure 18:
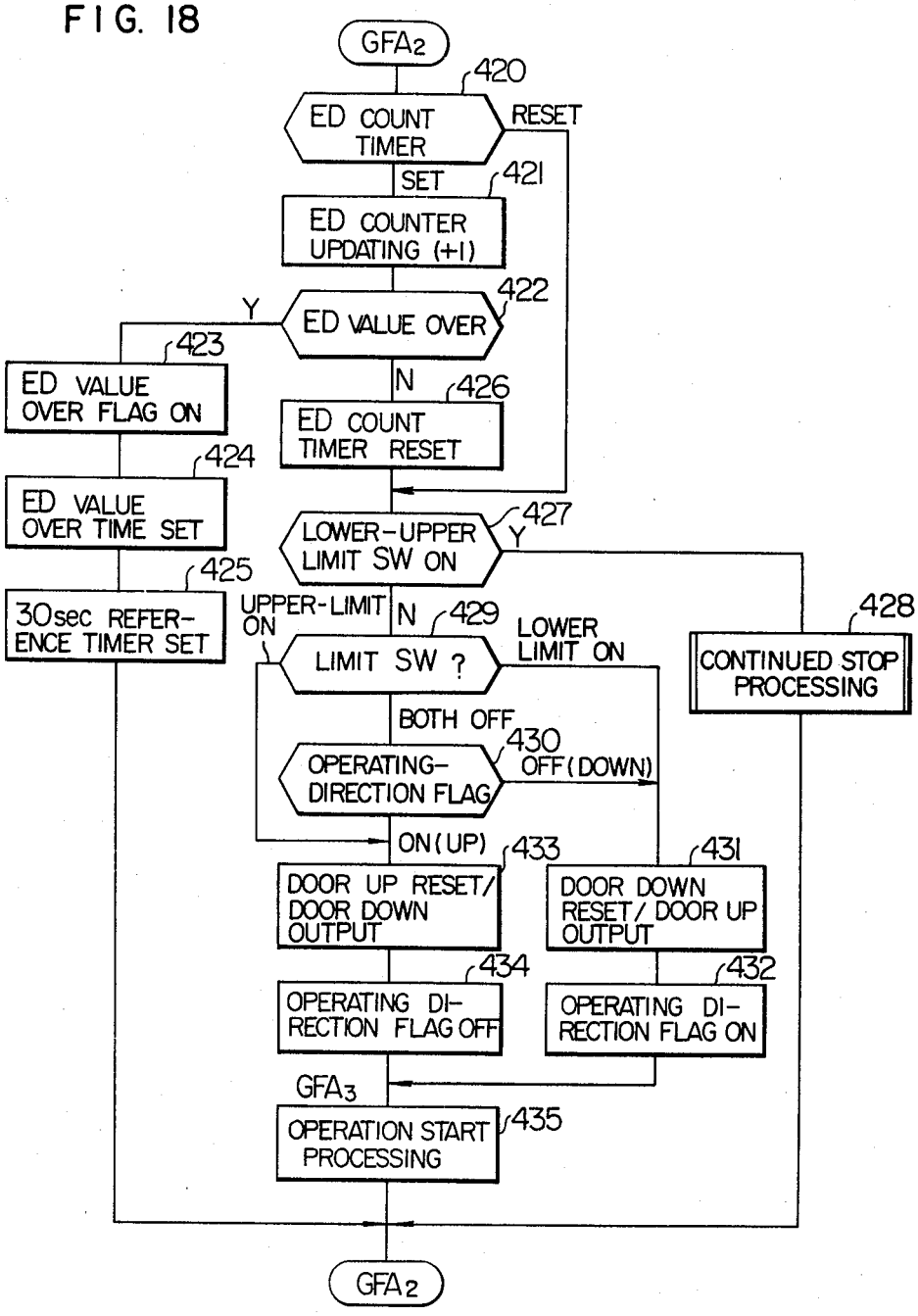

Now, the stop-to-operation processing step 388 will be explained with reference to FIG. 18.

First, it is determined whether the ED counter timer 420 is set. This corresponds to the timer $TM_{10}$ in FIG. 10. If it is set, the condition I shown in FIG. 11 is involved, so that the ED counter updating (+1) 421 is taken. If the timer is reset, on the other hand, it means the condition II.

Then the ED value over 422 is checked. If the ED value is exceeded, the ED value over flag on 423, the ED value over timer set 424 and the 30 sec reference timer set 425 (corresponding to the timer $TM_9$ in FIG. 10) are taken.

In the event that the ED value is not exceeded, however, the ED count timer reset 426 is taken for the purpose of initial clear of the ED counter.

Next, the upper-lower limit SW on 427 is checked. This is for determining a fault if both the upper and lower limit switches which are not normally simultaneously operable are on, in which case the continued stop processing step 428 is taken thereby keeping the door inoperative.

The limit SW 429 is checked. If the upper limit SW is on, the downward movement output is used; if the lower limit SW is on, the upward movement output is used; and if neither the upper or lower limit switch is on, the operating direction flag 430 is used, all to determine a mode. The limit SW input signal is given priority over the operating direction as a history mode. The operating direction flag, which is a stored in the temporary memory circuit 349 in FIG. 9, is off in view of the fact that it is entirely cleared at the time of power throw-in. In other words, the flag is reversely indicative, i.e., the flag-off means an upward movement, and the flag-on the downward movement. In the case of flag off, therefore, the door downward movement reset/-door upward output 431 is taken, followed by the operating direction flag on 432 in order to indicate the downward movement that follows. By these processes, the door operating direction after power throw-in is fixed at upward movement.

In the case where the operating direction flag 430 is on, by contrast, the door upward movement reset/door downward movement output 433 and the operating direction flag off 434 are taken, thus determining that the next operating direction is up. After setting the operating direction flag, the operation start process 435 is taken.

Figure 19:
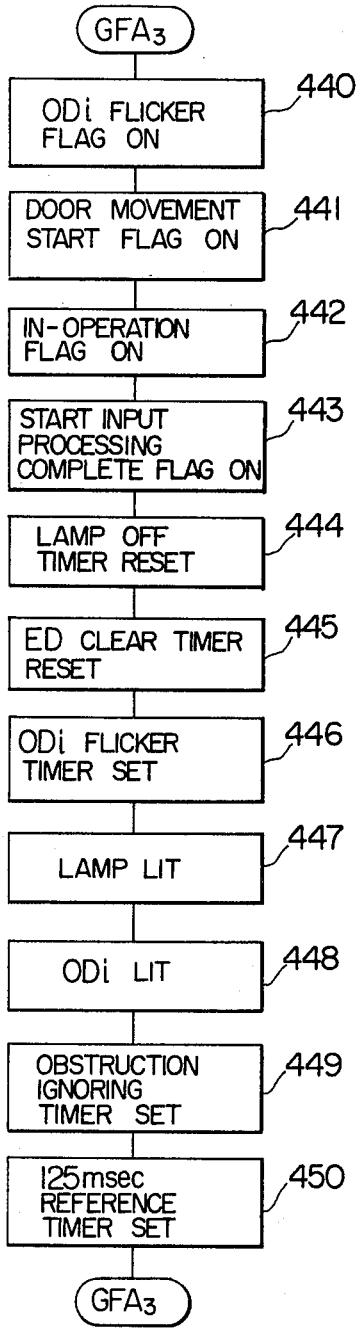

Next, the operation start processing step 435 will be explained with reference to FIG. 19.

In this process, before starting the operation, all related flags and timers are set and the lamp-on signal is produced.

Then, the ODi flicker flag on 440, the door movement start flag on 441, the in-operation flag on 442, the start input process complete flag on 443, the lamp off timer reset 444 (corresponding to the timer $TM_{12}$ in FIG. 10), the ED clear timer reset 455 (corresponding to the timer $TM_{11}$ in FIG. 10), the ODi flicker timer set 446 (corresponding to the timer $TM_5$ in FIG. 10), the lamp on 447, the obstruction ignoring timer set 449 (corresponding to the timer $TM_6$ in FIG. 10), and the 125 msec reference timer set 450 (corresponding to the timer $TM_3$ in FIG. 10) are taken in that order.

Figure 20:
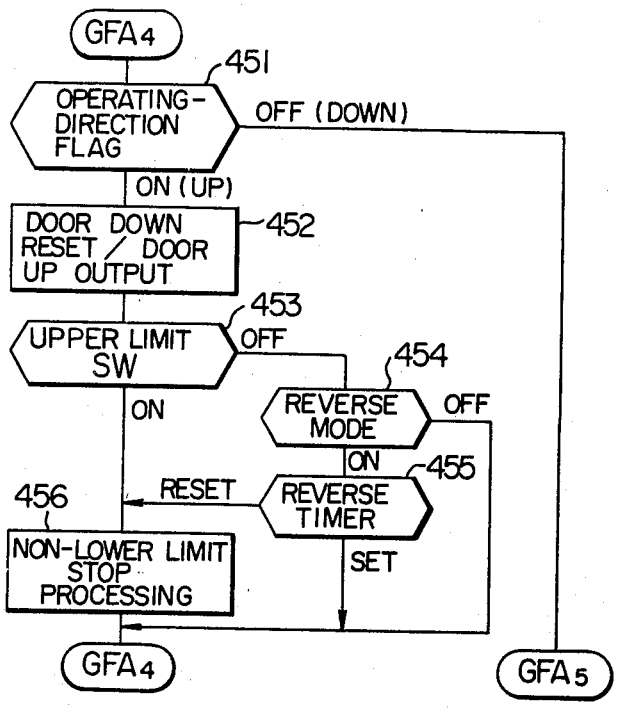
Figure 21:
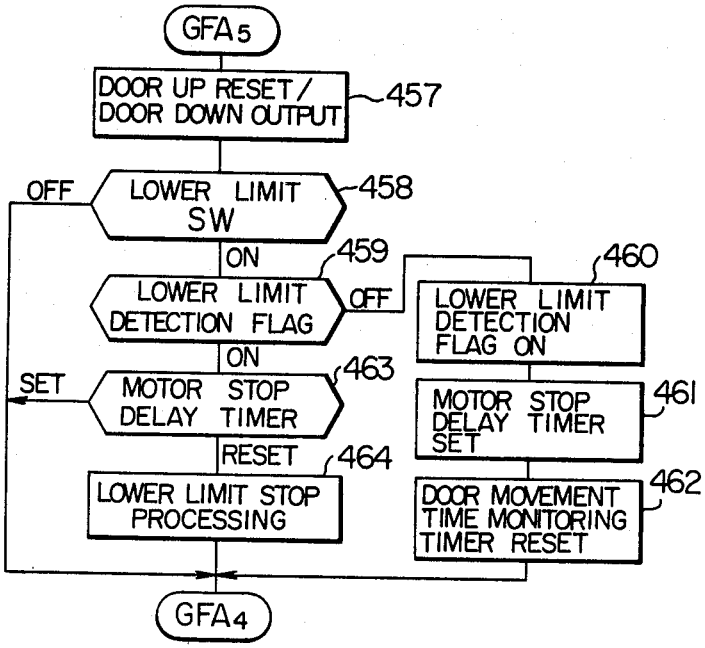

The in-operation processing 383 will be explained with reference to FIGS. 20 and 21.

In this process, the states 304 and 306 shown in FIG. 6 are primarily executed. First, the operating direction flag 451 is checked, and if it is on, the door downward movement reset/door upward movement output 452 is always taken. After that, the upper limit SW check 453 is made, and if it is on, the non-lower limit stop processing 456 is taken. If the upper limit SW is off, the reverse mode 454 is checked. In the case where this mode 454 is on, the reverser timer is checked at 455. This timer is $TM_6$ in FIG. 10 and when it is reset, it shows one foot up as shown in the state 306 in FIG. 6. Therefore, the next process to be taken is the lower limit stoppage. If the timer $TM_6$ is set, by contrast, the operation is continued.

The operating direction flag 451 is checked and if it is off, the door upward movement reset/door downward movement output 457 is always repeated. Then, the lower limit SW 458 is checked, and if it is on, the lower limit detection flag 459 is checked. If the same flag is off, by contrast, it is immediately after the lower limit input, so that the lower limit detection flag on 460 is taken while at the same time taking the motor stop delay timer set 461. This corresponds to the timer $TM_2$ in FIG. 10. Next, the door movement time monitoring timer reset 462 is taken. This corresponds to the timer $TM_8$ in FIG. 10.

In the case where the lower limit detection flag 459 is on, the motor stop delay timer is checked at 463. If it is reset, it confirms that the door has moved down for a predetermined length of time as shown in the state 304 in FIG. 6, and therefore the following step to be taken is the lower limit stop processing 464.

According to the embodiment of the invention under consideration, the timer $TM_2$ is set at 225 msec.

Figure 22:
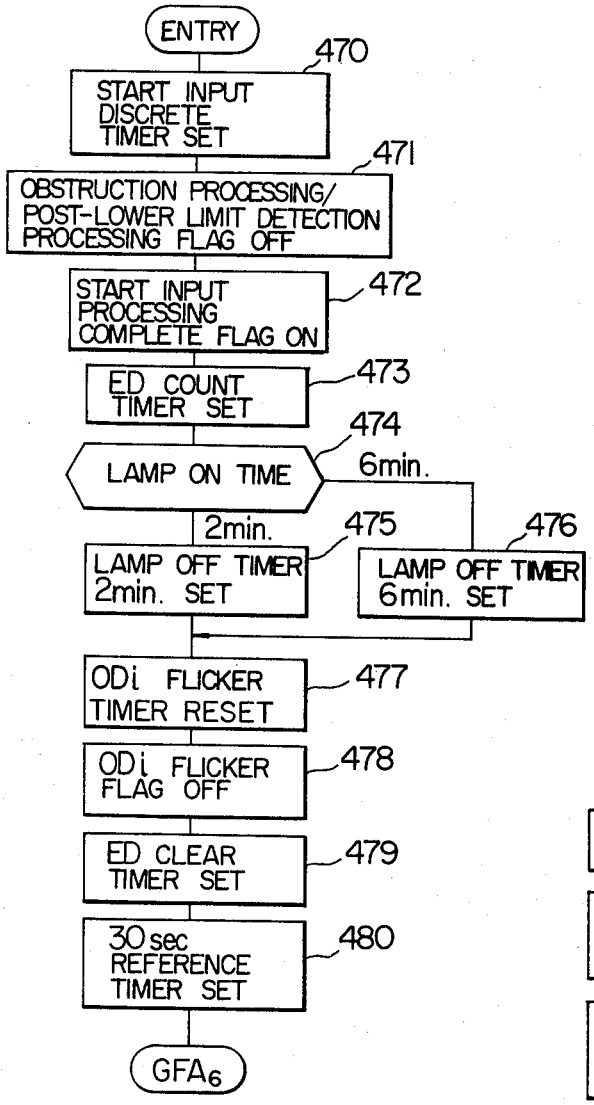
Figure 23:
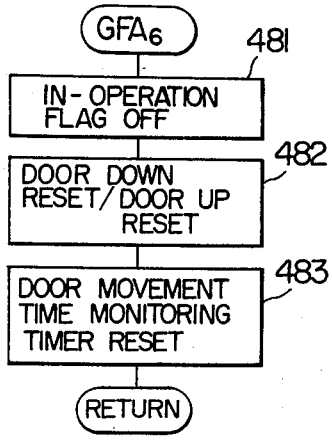
Figure 24:
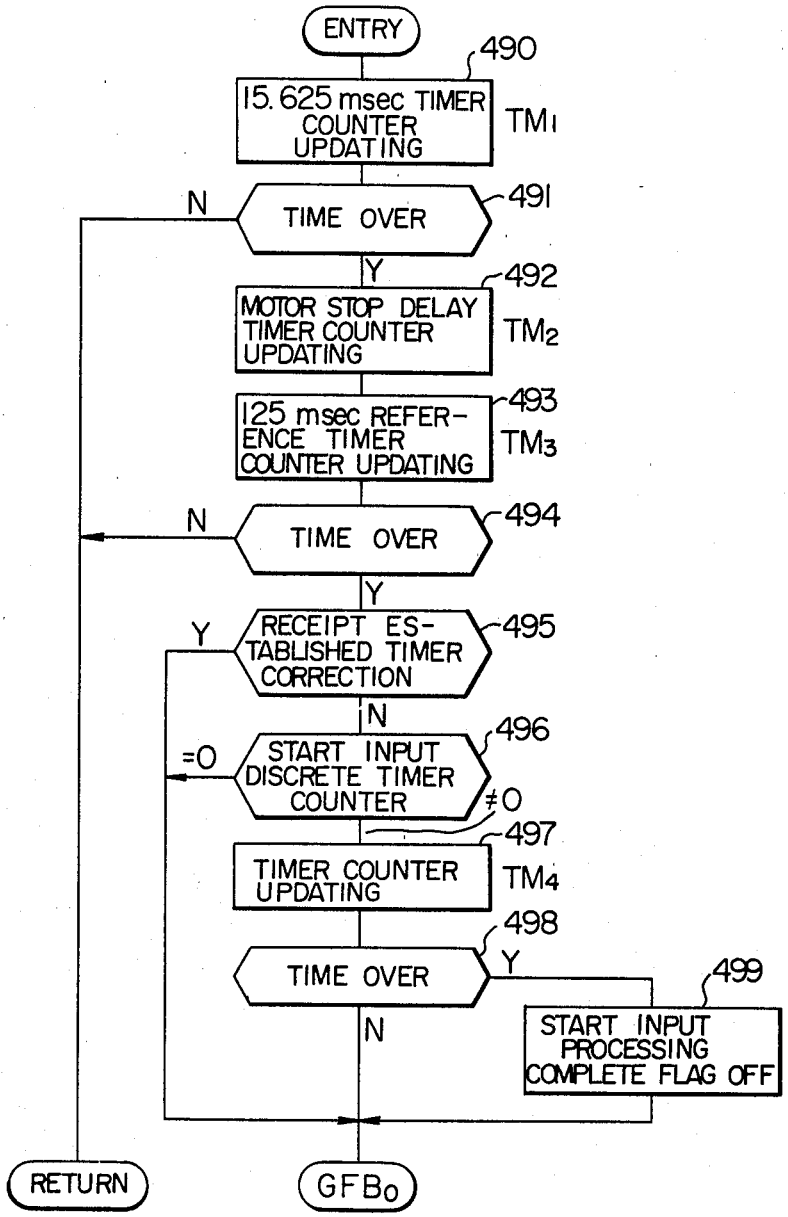
Figure 25:
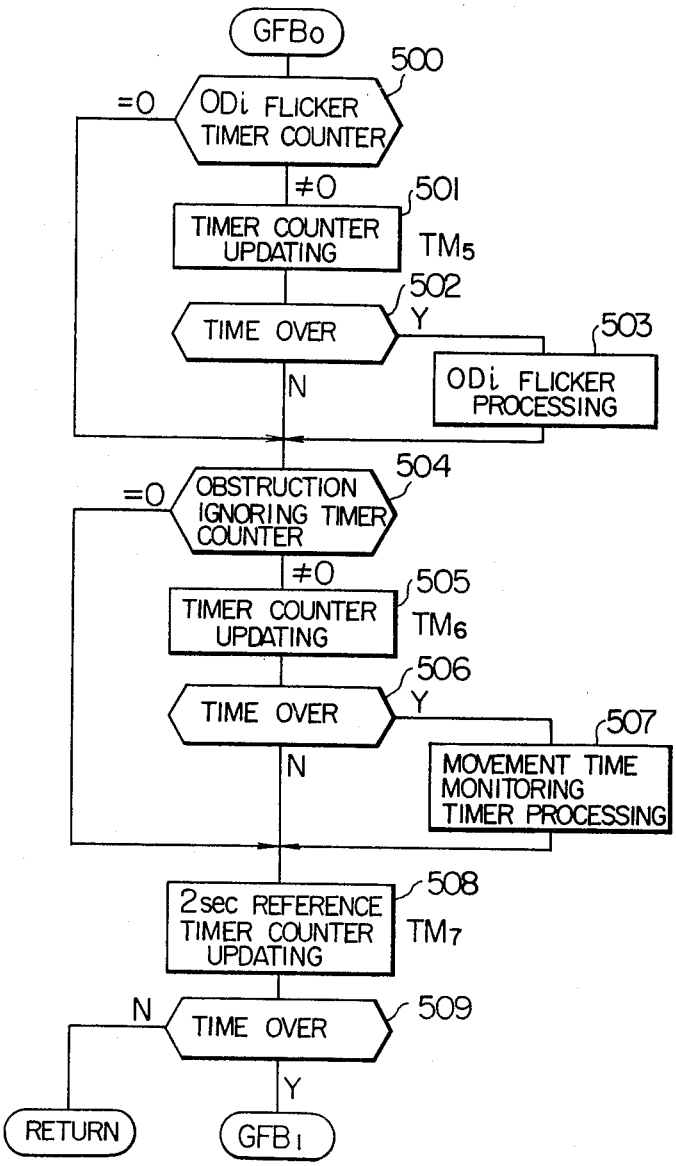
Figure 26:
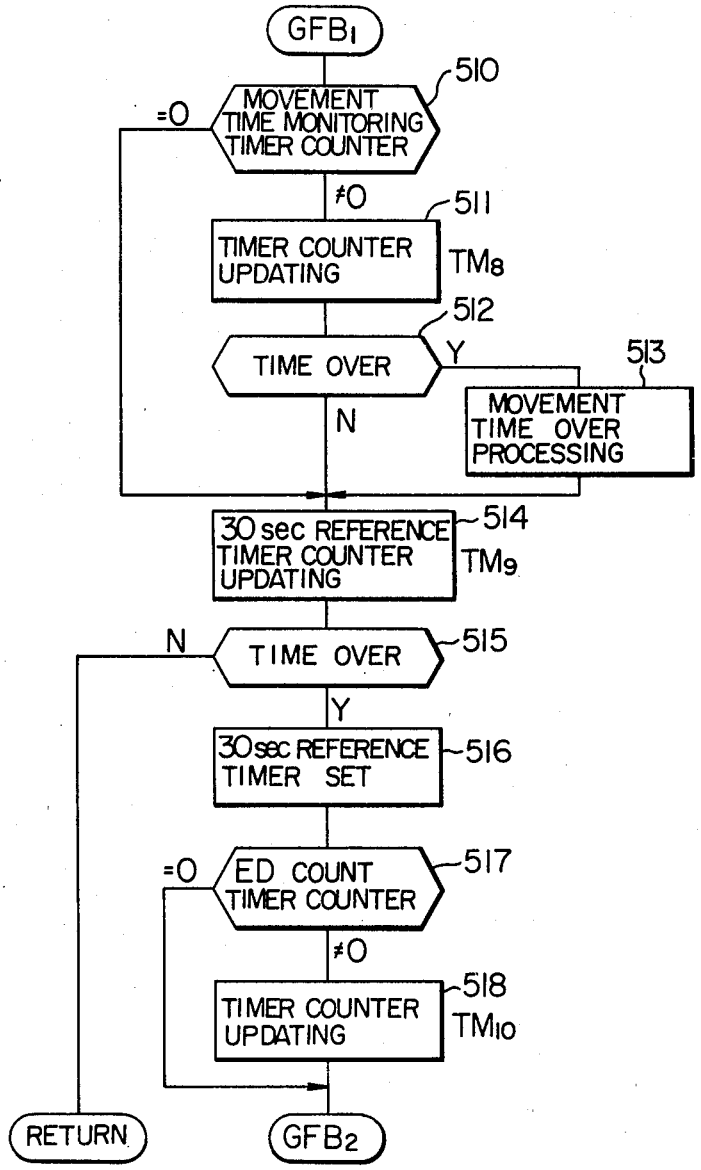
Figure 27:
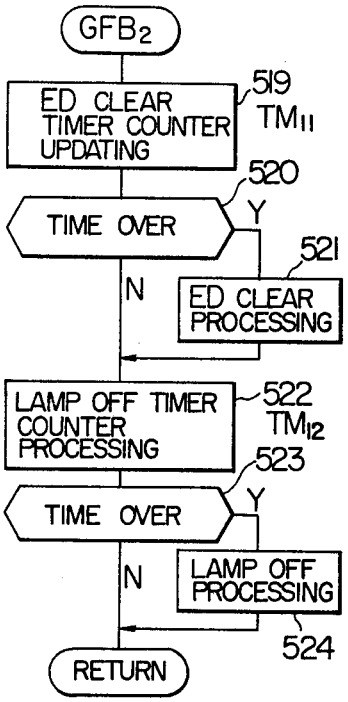

Next, the lower limit stop and non-lower limit stop processing will be explained with reference to FIGS. 22 and 23, and the continued stop processing with reference to FIG. 23.

The start input discrete timer set 470, the obstruction processing/post-lower limit detection processing flag off 471, and the start input process complete flag on 472 are taken. The stoppage in response to the operating command input is considered the same as the stoppage in response to the input to the upper or lower limit switch.

Next, the ED count timer set 473 is taken. This corresponds to the timer $TM_{10}$ in FIG. 10.

In order to determine the lamp-on time, the two-minute or six-minute select signal set by the additional circuit 316 in FIG. 8 is checked at the lamp-on time 474, and also the lamp-off timer two minutes 475 or the lamp-off timer six minutes 476 is selected. Next, the ODi flicker timer reset 477, the ODi flicker flag off 478 and the ED clear timer set 479 are taken. This corresponds to the timer $TM_{11}$ in FIG. 10 which is set at six minutes in this embodiment of the invention. Next, the 30-sec reference timer set 480 is taken.

The next steps to be taken include the inoperation flag off 481, the door downward movement reset/door upward movement reset 482 and the door movement time monitoring timer reset 483 are executed.

The timer processing 368 in the main flow chart of FIG. 14 will be explained below with reference to FIGS. 24 to 27. In the processing sections of this flow chart, the number of steps of each section are counted by itself and used as a timer, and each timer counter corresponds to a related element in FIG. 10. In the flow charts under consideration, marks will be attached to clarify the correspondence on the map.

The 15.625 msec timer counter updating 490 is taken and the timer over of the timer $TM_1$ is checked for at the timer over 491. One cycle of the main flow chart includes 97 steps. When this is counted in four bits, a time over occurs at the 16th time, resulting in an overflow. One step is 10 $\mu$sec, so that one cycle corresponds to $16 \times 97$ steps $\times 10$ $\mu$sec $= 15.52$ msec. The timer of 15.625 msec was considered because of the relation with a higher order counter contents 125 msec, and it is assumed that the basic parts already include an error of about 1%. The output of the time over 491 is produced at intervals of 15.625 msec, which output is processed through the motor stop delay timer counter updating 492 (timer $TM_2$) and the 125 msec reference timer counter updating 493 (timers $TM_3$ which count +2 each), with the result that the overflow time of 125 msec at the time over 494 is assured.

The next step, i.e., the receiving established timer correction 495 will be described later. In the timer correction for this step, the discrete timer is not updated. In the absence of the receiving established timer correction, the start input discrete timer counter 496 is checked. When the count is not zero, the timer counter updating 497 (timer $TM_4$) is executed and checked at the time over 498. If there is a time over, the start input process complete flag off 499 is taken.

The ODi flicker counter 500 is checked. When the count is not zero, the timer counter updating 501 (timer $TM_5$) is executed and checked at time over 502. If there is any time over, the ODi flicker processing step 503 is taken. In other words, the ODi is made to flicker by the ODi flicker flag, and thus the conditions 300 and 302 in FIG. 12 are executed.

Next, the obstruction ignoring timer counter is checked at 504. If it is not zero, the timer counter updating 505 (timer $TM_6$) is taken and checked at time over 506. If there is a time over, the movement time monitoring timer processing step 507 is taken. At this step, the door movement start flag is made off and the movement time monitoring timer is set.

Up to this point, the 2-sec reference timer counter updating 508 (timer $TM_7$) is executed and checked at time over 509. If there is a time over, it involves the passage of two seconds.

Next, the movement time monitoring timer counter 510 is checked. If it is not zero, the timer counter updating 511 (timer $TM_8$) is taken and checked at time over 512. If there is any time over, the movement time over processing is effected. In this case, the obstruction flag on and the reverse mode off are involved. In other words, a time over occurs 25 seconds after door start in the absence of an input from the upper limit switch, the lower limit switch or the obstruction limit switch. This output is equivalent to the obstruction detection.

Next, the 30-sec reference timer counter updating 514 (timer $TM_9$) is taken and checked at time over 515. If there is any time over, the lapse of 30 seconds is involved.

The 30 sec reference timer set 516 is then taken. This is for the reason that the 30-sec reference timer $TM_9$ is based on the timer $TM_7$, and overflow is required at the count 15. The counter for the timer $TM_9$ is set at "1".

The ED count timer counter 517 is checked. If it is not zero, the timer counter updating 518 (timer $TM_{10}$) is taken.

next, the ED clear timer counter updating 519 (timer $TM_{11}$) is taken and checked at the timer over 520.

If there is a time over, the ED clear processing is effected at 521. In this process, the ED counter is cleared and the ED value over flag is turned off, attaining the condition equivalent to the state III in FIG. 11.

Next, the lamp-off timer counter updating 522 (timer $TM_{12}$) is executed and checked for time over at 523. If there is any time over, the lamp off processing step 524 is taken.

Prior to explaining the receiving process 365 in the main flow chart of FIG. 14, the transmission-receiving system will be described again.

Figure 28:
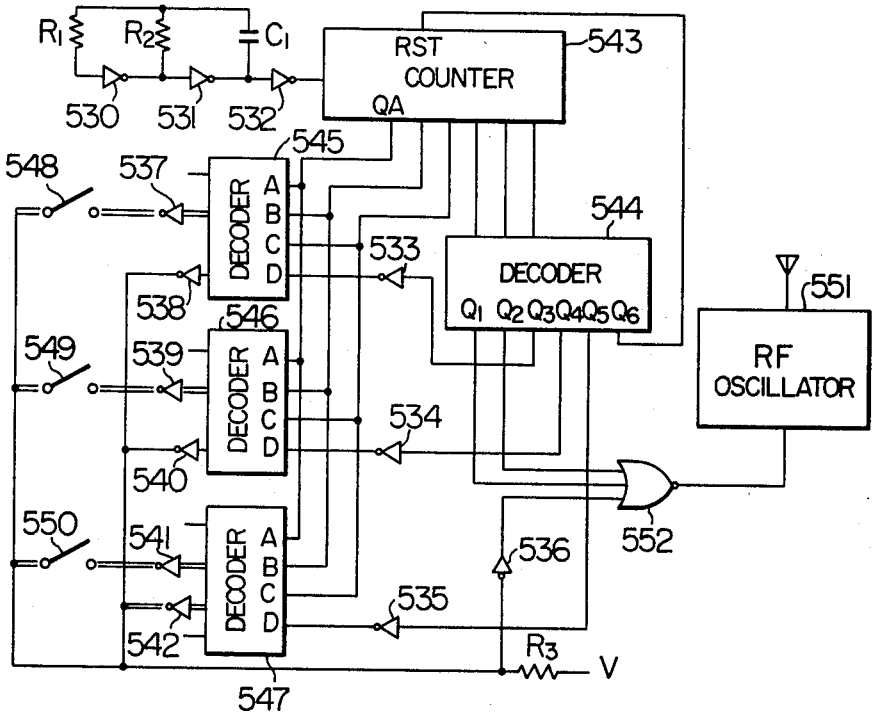
FIGS. 28 is a block diagram of a radio control transmitter.

An example of the circuit for the transmitter 331 will be explained with reference to FIG. 28. Inverters 530, 531, resistors $R_1$, $R_2$ and a capacitor $C_1$ make up an oscillator circuit, the output of which is applied through an inverter 532 to a counter 543. The three lowest-order bits of the counter 543 are applied to the decoders 545, 546 and 547, while the three highest-order bits are applied to the decoder 544. The outputs $Q_1$ to $Q_5$ obtained by decoding the highest three bits are equivalent to eight times the least bit QA of the counter 543. Thus the outputs $Q_1$ to $Q_5$ of the decoder 544 make up 40 bits. The outputs $Q_1$ and $Q_2$ are applied to a 3-input NAND 522, thereby making up a synchronizing signal of 16 bits. At output $Q_3$, the decoder 545 is selected through the inverter 533, so that the three lowest bits of the counter 543 are decoded and the output of the decoder 545 is applied to an inverter 537 of open drain type (corresponding to six inverters). Thus the same output sequentially scans the bit switch 548 with six contacts providing a bit setting part, and the on-off data is applied to the 3-input NAND 552 through the inverter 536. In similar fashion, by way of the output $Q_4$ of the decoder 544, the decoder 546 is selected through the inverter 534, and the output of the decoder 546 scans the bit switch 549 (with six contacts) through the inverter 539 of open drain type (corresponding to six inverters). Also, by way of the output $Q_5$ of the decoder 544, the decoder 547 is selected through the inverter 535, and the output of the decoder 547 is applied to the inverter 541 (with three inverters) of open drain type, thus sequentially scanning the bit switch 550 with three contacts. The inverters 538 and 540 of open drain type correspond to the stop bit SP, while the inverters 542 with three inverters of open drain type corresponds to one frame of stop bits FSP.

By this operation, the RF oscillator 551 making up a UHF oscillator section is subjected to on-off control by the three-input NAND 552, thus producing an electric wave output of the transmittor 331 as shown in FIG. 13.

The data thus transmitted is received by the receiving circuit 330 including a super regeneration circuit, and then applied to the logic processing circuit 311 including a bit setting circuit 321. An embodiment of the bit setting circuit 321 is shown in FIG. 29. This circuit comprises bit switches 560, 561, 562, and diodes $Di_1$ to $Di_{10}$ and sequentially controls the 10-bit outputs of the logic processing circuits $R_{00}$ to $R_{03}$, $R_{10}$ to $R_{13}$ and $D_{01}$ to $D_{02}$, so that only one bit is kept at "1" while the other nine bits are made "0" (in high impedance condition in spite of open drain type), with the result that the on-off data of the bit switches is collected by way of input ports $I_1$ and $I_2$.

Figure 30:
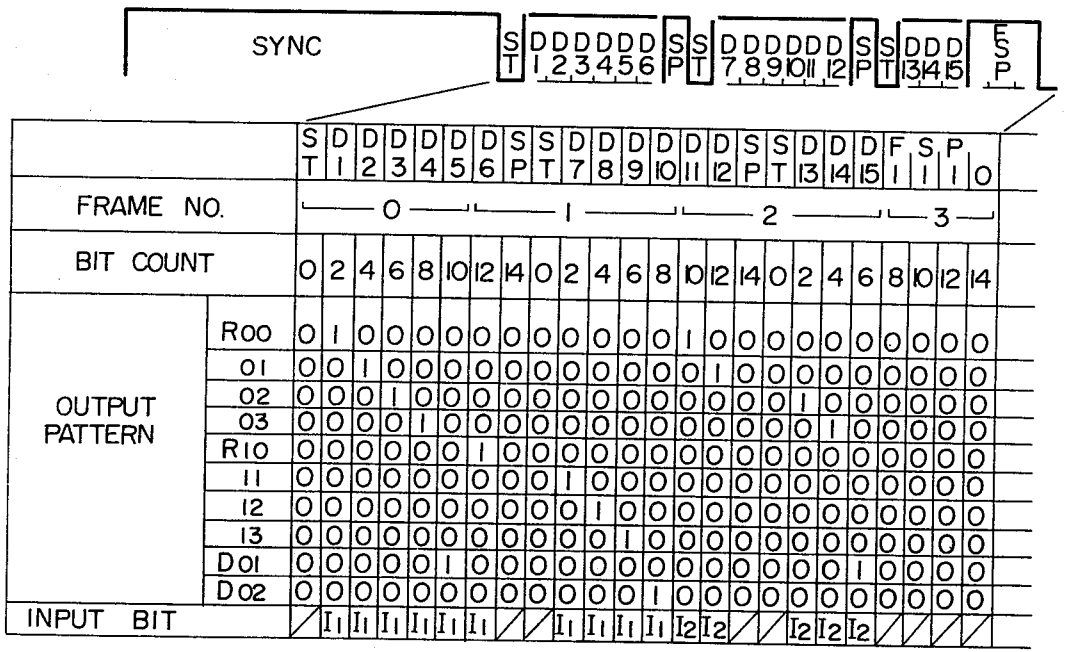
FIG. 30 shows a bit set pattern.

FIG. 30 shows a set pattern for collection of the bit switch data. The frame No. corresponds to the data, the data $D_1$ to $D_5$ corresponding to frame No. 0, the data $D_6$ to $D_{10}$ to frame No. 1, the data $D_{11}$ to $D_{15}$ to frame No. 2, and the frame stop bit to frame No. 3. Also, as a bit counter, an even number is assigned to each bit between start bit SP and stop bit SP. The output pattern and the input port for collection of the bit switch data are also shown.

Next, the receiving process will be explained below with reference to FIGS. 31 to 37. First, explanation will be made with reference to FIG. 31.

Figure 37:
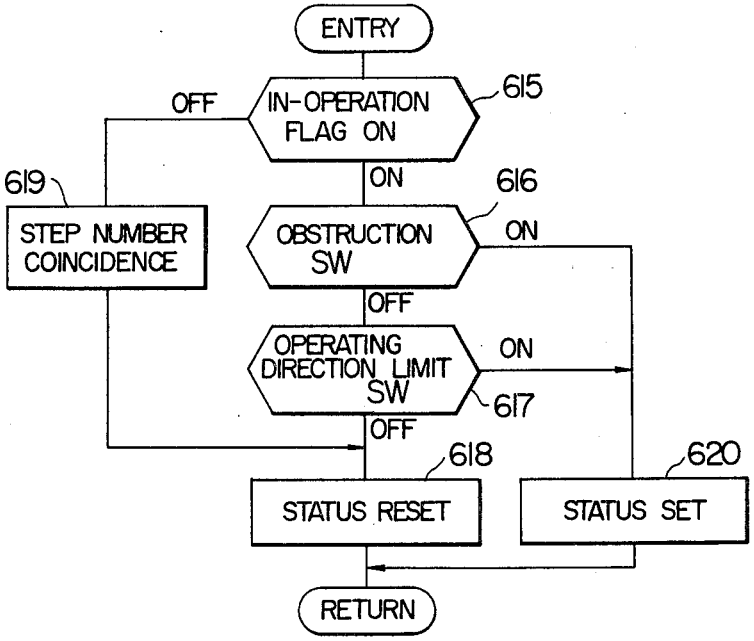

The obstruction limit SW check 570 is for checking the limit SW of an obstruction and the operating direction while the door is in operation. When the door is not in operation, the number of processing steps is rendered coincident, as the detail thereof is shown in FIG. 37. If an obstruction is found by this process or the operating direction limit SW is on, the status flag (located within the condition indication register of FIG. 9) is set. The next step is the checking of the obstruction limit SW input 571 which is effected by checking the above-mentioned status flag. If the status flag is on, a jump is made to GFC1. When the status flag is off, on the other hand, the sync signal counter updating 572 is taken. The sync signal counter is provided by eight bits as shown in FIG. 10 within the temporary memory circuit 349 shown in FIG. 9. It is determined whether or not the value of the above-mentioned counter is maintained for longer than a predetermined length of time. In other words, the maximum value of the waveform applied as an original sync signal is set. And if the counter value is larger than that maximum value, an abnormality is judged and a jump is made to GFC1. If the result of the step sync signal counter 2 upper limits 573 is "No", the step "the received data is 0" is taken at 574, thus determining whether or not the data is zero, i.e., whether or not the sync signal is ended. If the data is not zero, the processes are returned to the obstruction limit SW check 570. The loop $L_1$ shown in the drawing is repeated till the received data becomes zero. If the data is zero at the step 574 "received data=0", the sync signal counter 2 lower limit 575 is checked. In other words, the maximum value of the waveform applied as an original sync signal is set, and if the count is lower than that, an abnormal condition is judged and a jump is made to GFC1.

If the result of the sync signal counter 2 lower limit value 575 is "Yes", the DiPSW read output pattern initial value set 576 and the frame No. initial value set 577 are taken as shown in FIG. 30.

Next, the flow chart of FIG. 32 will be explained.

Figure 31:
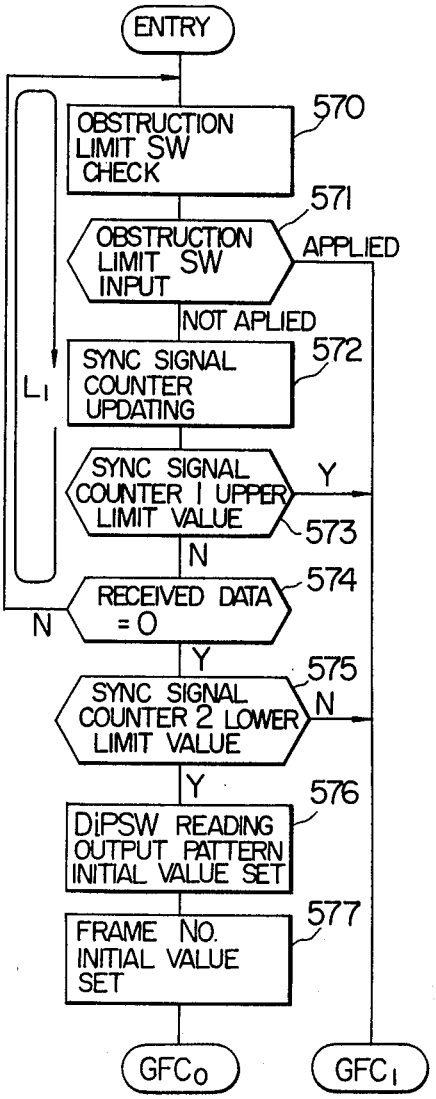
FIGS. 31 to 37 are flowcharts showing various operations.

The sampling timing counter initial value set 1578 is taken. In this process, with the next bit counter initial value set 1579 set, the length of time required for processing the sync signal counter 2 lower limit 575, the DiPSW read output pattern initial value set 576 and the frame No. initial value set 577 in FIG. 31 is corrected as an error before the sampling start.

The obstruction limit SW check 1580 checks the obstruction or the operating direction limit switch when the door is in operation. When the door is not in operation, the number of processing steps is made coincident with each other, as the detail thereof is shown in FIG. 37. In this process, in the presence of an obstruction or when the operating direction limit SW is on, the status flag (located in the condition indication register of FIG. 9) is set.

The next process of checking the obstruction limit SW input 1581 is performed by checking the above-mentioned status flag. When the status flag is on, a jump is made to GFC1.

Next, the start bit sampling 1582 is checked. As mentioned above, the sampling period is 1/32 for the start bit, and 1/16 for the others. If the answer is "Yes" in this step, the sampling counter updating 1583 updates by +2 to 1/32, while the sampling counter 1584 updates by +1.

The sampling time over 1585 is checked, and if the time is not yet over, the obstruction limit SW check 1580 is returned to. The loop $L_2$ shown in the drawing is repeated until a sampling time over.

Figure 32:
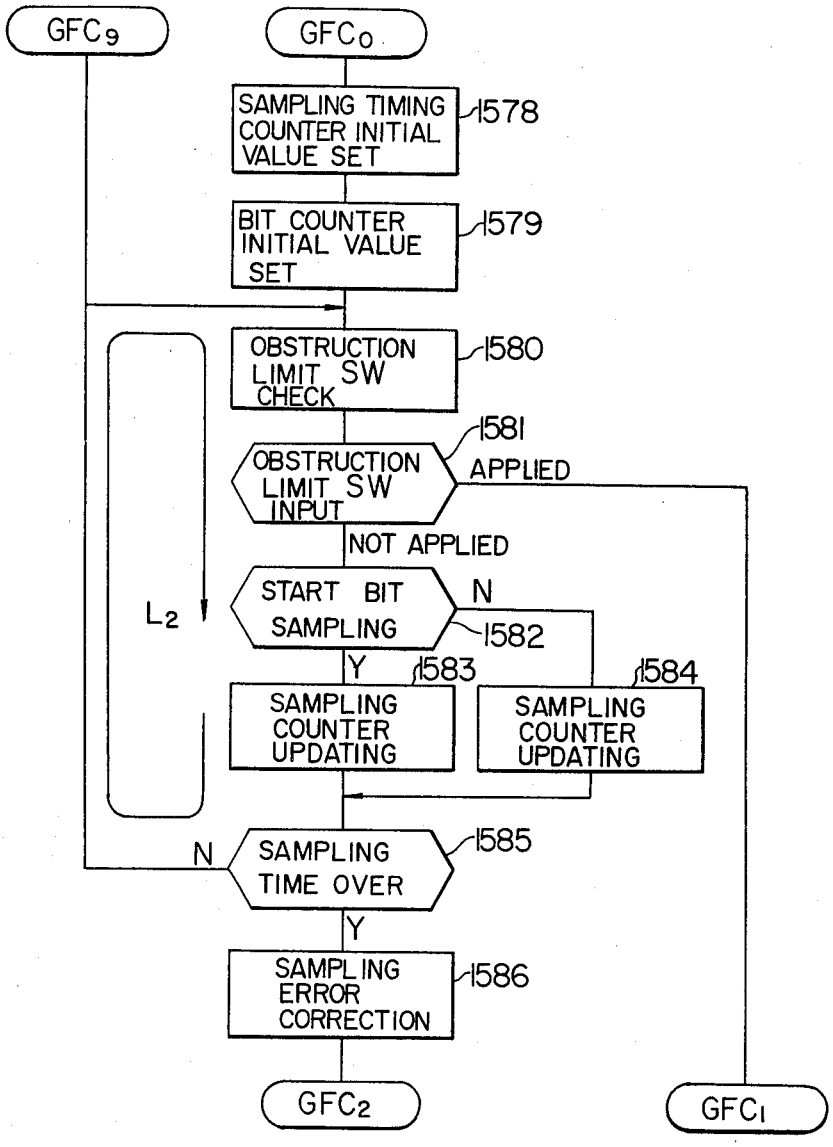

The number of processing steps of the loop $L_1$ in FIG. 31 is rendered the same as the number of processing steps of the loop $L_2$ of FIG. 32. If the answer at the sampling time over 1585 is "Yes", the sampling error correction 1586 is taken.

The number of processing steps at the $L_1$ loop is 32. Therefore, 32 processing steps per loop multiplied by 1/16 equals two processing steps per loop. Thus the value of the lower digits of the sync counter is counted as two processing steps for each count, thus correcting the error.

Next, the flow chart of FIG. 33 will be explained. The received data is collected into the carrier at 578. This carrier is included in the condition indication register 346 shown in FIG. 9. Next, it is determined at the frame No. 3 579 whether or not the frame No. 3 is involved, i.e., whether or not the frame stop bit FSP is involved. If it is involved, a jump is made to GFC3. If the answer is "No", on the other hand, the next step is taken to check the start bit 580. Whether or not it is a start bit is judged with reference to the bit count. If the bit count is zero, a jump is made to GFC4. If the bit count is not zero, by contrast, the next step is taken thereby to check the stop bit 581. Whether or not a stop bit is involved is determined from the bit count. If the bit count is 14, a jump is made to GFC5.

If it is not a stop bit, on the other hand, the DiPSW output $D_{01}$ and $D_{02}$ reset 582 and the DiPSW read output pattern load 583 are taken. This is followed by the checking of the frame No. 1 584. If the frame No. is not 1, the DiPSW output 0 to 3 output 585 is taken. Then the output pattern 586 is checked, and if it is zero, the DiPSW output $D_{01}$ output 587 is taken; while if the above-mentioned output pattern is zero, on the other hand, the DiPSW output $D_{01}$ reset 588 is taken. As will be seen from the output pattern, $R_{00}$ to $R_{03}$ are a 4-bit latch, while $D_{01}$ is a 1-bit latch. Because of this configuration, the above-mentioned method for setting the output pattern is used. This is also the case with the DiPSW output 4 to 7 output 589, the checking of the output pattern 590, the DiPSW output $D_{01}$ output 591 and the reset of the DiPSW output $D_{02}$ at 592 for frame No. 1.

Next, the flow chart of FIG. 34 will be explained. After is determined that a stop bit input is involved by the checking of the stop bit 581 in FIG. 33, the stop bit normal 593 checks to see that the particular signal is a stop bit, i.e., "1". If a "0" input is involved, it is not a stop bit. This is not a normal condition and therefore subsequent sampling steps are not taken, but a jump is made to GFC1.

If the checking of the stop bit normal 593 shows that a normal stop bit is involved, the next step is taken. The checking of the received data 594, the obstruction limit SW check 595 and the obstruction limit SW input check 596 are repeated. In the meantime, after confirming at the received data 594 that the received data is "0", this loop is left and transferred to the next sampling counter initial value set 598. After that, a jump is made to GFC10. In this process, the level check is effected at the received data 594. In view of the fact that a new sampling is started from the fall point of the particular signal, the error up to that point of sampling is eliminated.

If the output pattern is not "0" as a result of the checking at the "output pattern=0" at 607, the processing in the same frame is being conducted, and the output pattern updating (double) 610 is taken.

The next step is the sampling counter initial value set 610, followed by the bit counter updating (+2) at 611. A jump is made to GFC9 shown in FIG. 32.

Figure 35:
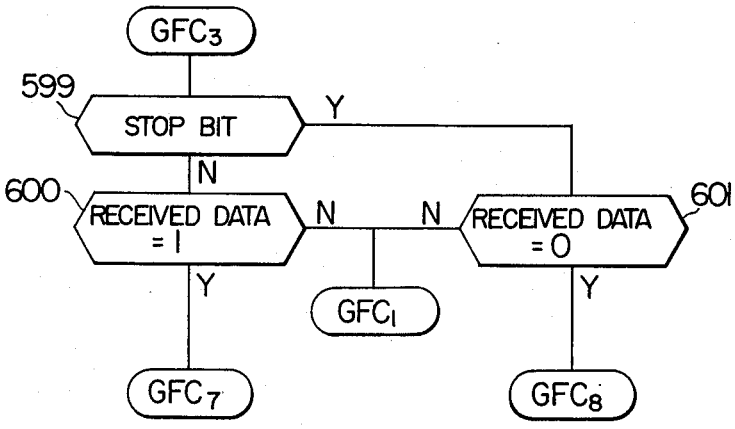

In FIG. 35, a jump is made to GFC8 in response to a data coincidence. This requires an average processing time of 80 msec in the receiving process flow chart (because one bit requires 2 msec and one frame 40 bits). As a result, the receiving process 365 in FIG. 14 greatly affects the timer processing 368. To prevent this inconvenience, according to the embodiment under consideration, the 15.625 msec timer at the timer processing 368 is called five times at the timer counter correction 612. By approximate processing, the main timer is thus corrected.

Next, the start input discrete timer set 613 is taken, followed by the receiving process counter zero clear/-receiving i/O port reset 614.

Figure 33:
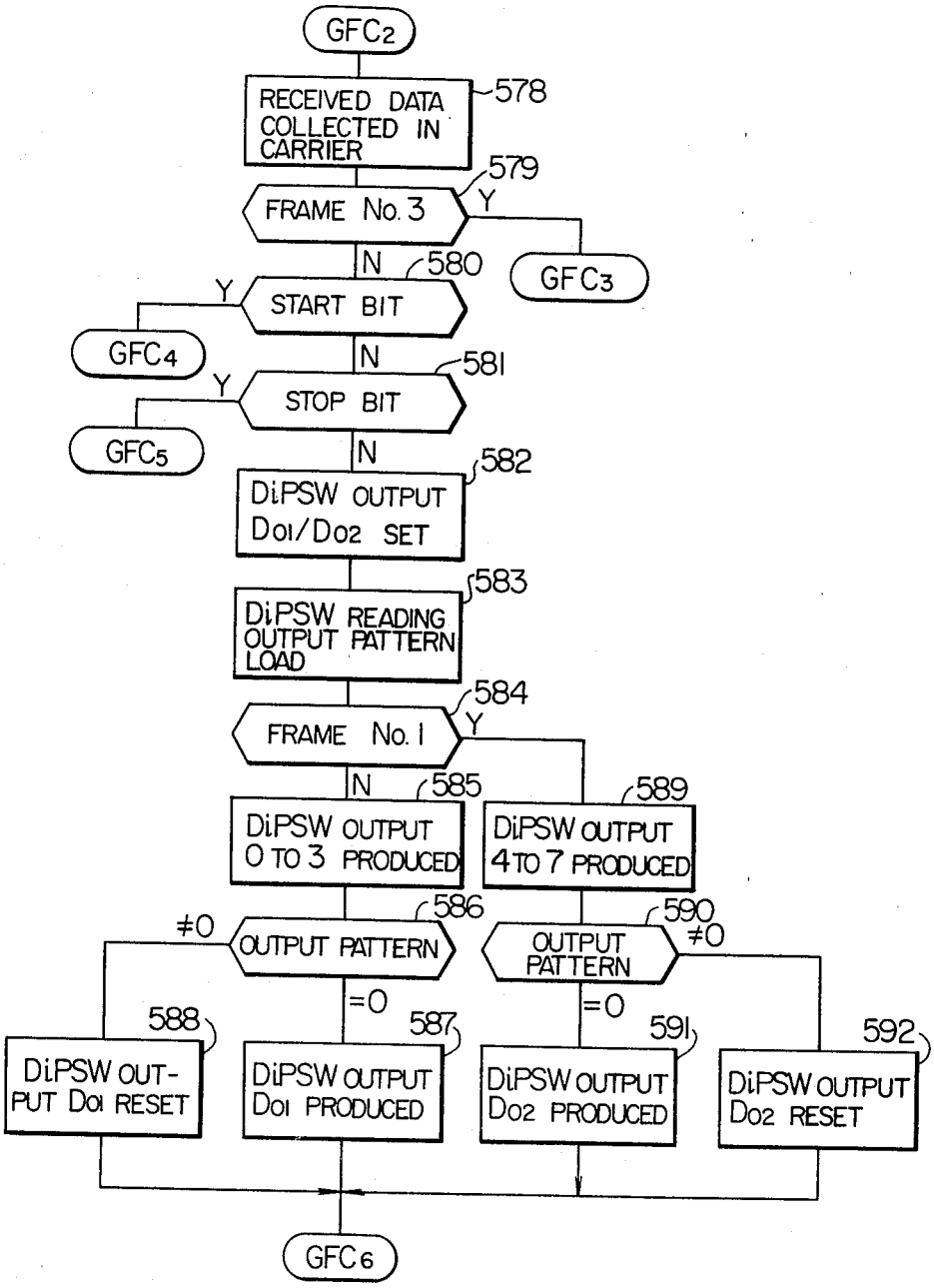
Figure 34:
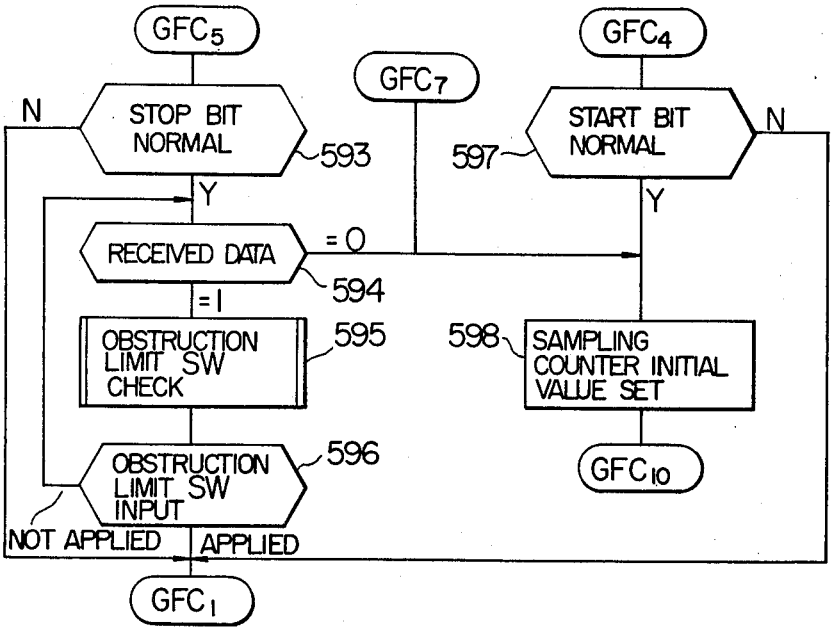

After it is decided that a start bit input is involved at the start bit 580 in FIG. 33, the start bit normal 597 checks to see that the particular signal is a start bit, i.e. "0". If it is a "1" signal, by contrast, it is not a start bit, and therefore a normal receiving condition is not involved, so that subsequent sampling processes are eliminated. Instead, a jump is made to GFC1.

If the checking at the start bit normal 597 shows a normal start bit, the next step, i.e., the sampling counter initial value set 598 is taken.

The process shown in FIG. 35 is made in the case where it is determined that the frame No. 3 is involved by the checking of the frame No. 3 579 in FIG. 33.

Whether or not a stop bit is involved is determined by a bit counter at the stop bit 599. If the bit count is 8, 10 or 12, the "received data=0" is taken at 600. If the bit count is any one of the above-mentioned values, the received data must be "1", in which case a jump to GFC7 shows a normal condition. If the received data is "0", by contrast, the receiving condition is abnormal and a jump is made to GFC1.

Also, if the checking of the stop bit 599 shows that the count is 14, the "received data=0" 601 is checked. When the bit count is 14 as shown above, the received data is required to be "0", and the jump to GFC8 is normal. If the received data is "1", on the other hand, the receiving condition is abnormal and a jump is made to GFC1.

Figure 36:
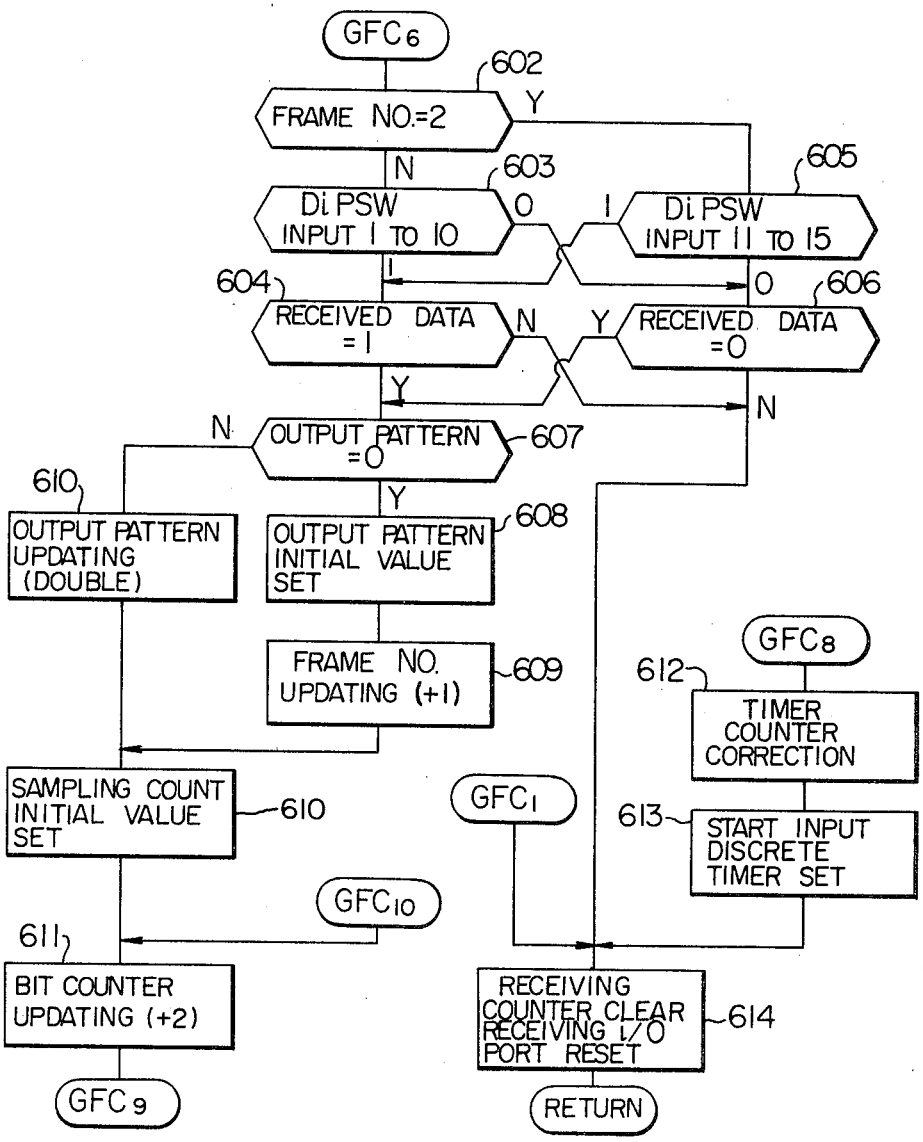

FIG. 36 shows a continuation of the processes from FIG. 33. By checking the "frame No.=2" at 602, the input port of the DiPSW set is discriminated. If frame No.=2 as shown in FIG. 30, the input port is $I_2$ corresponding to DiPSW inputs 11 to 15. Thus the DiPSW inputs 11 to 15 are checked at 605, and if it is "1", the "received data=1" at 604 is checked. If the signal is "0", by contrast, the "received data=0" at 606 is checked. If coincidence is attained as a result of checking, the "output pattern=0" at 607 is checked. In the case of failure to coincide, on the other hand, the receiving process counter zero clear/receiving process i/O port reset 614 is taken.

If the frame No. is not 2 in this case, the input port is $I_1$ which corresponds to the DiPSW inputs 1 to 10. Thus, the DiPSW inputs 1 to 10 are checked at 604, and if it is "0", the "received data=0" at 606 is checked. If coincidence is attained, the "output pattern=0" at 607 is checked. In the case of coincidence failure, by contrast, the receiving process counter zero clear/receiving process i/O port reset 614 is taken.

The next step to be taken is the checking of the "output pattern=0" at 607. If the output pattern is "0", it means that the checking of the data 5 bits is completed, and it is necessary to set a new data collection pattern for the next frame.

For this purpose, the output pattern initial value set 608 is taken, and a "1" is set as an output pattern. Also, the frame No. updating (+1) 609 is taken. The next step to be taken is the sampling count initial value set 610, followed by the bit counter updating (+2) at 611. Then a jump is made to the position of GFC9 shown in FIG. 32.

The diagram of FIG. 37 shows the manner in which the obstruction limit SW is checked. First, the in-operation flag 615 is checked. Specifically, while the door is in operation, the obstruction SW 616 is checked. If the obstruction SW is on, the status flag set 620 is taken. In the case where the obstruction SW is off, on the other hand, the operating direction limit SW is checked at 617. If it is on, the status flag set 620 is taken. When it is off, on the other hand, the status reset 618 is taken.

In the event that the in-operation flag 615 is off, i.e., the door is stationary, coincidence with the number of steps required for operation is required. Otherwise, the timer must be changed in function between stoppage and operation of the door. Thus the step number coincidence 619 is taken.

The above-mentioned door operating device is disclosed in the specifications and drawings of U.S. patent applications already filed by us (corresponding to Japanese Patent Applications Nos. 21066/69, 21067/79 and 21068/79, invented by Sigeru Matsuoka, Toshio Tsubaki, Takeshi Tokunaga, Seiji Yonekura, Kenji Nakamura and Mitsuo Suzuki). Explanation will be made below of detection and processing of an abnormal condition in the garage. In FIG. 1, a fire detector and an intruder preventing device are installed as an example of abnormal condition detecting means. An example of the fire detector includes a fire detecting device 648 of what is generally called smoke detection-ionization type, which is installed on the garage ceiling. The intruder preventing device, on the other hand, includes a device of magnet reed switch type which is commonly used to detect the presence or absence of an intruder on the basis of a change in a combination of conditions. Specifically, in the presence of an intruder, the window 653 or the garage auxiliary door 660 will be open. In order to detect these conditions, magnets 651, 649 and reed switches 652, 650 are arranged to correspond to each other when the window 653 and the auxiliary door 660 are closed. The fire detecting device 648 and other detectors are connected through wires 657, 658 and 669 to a control device for logic analysis of the output signals from such detectors.

The control device 13 is provided with a control switch 654 for giving an instruction as to whether or not the abnormal condition detector is to be operated or not. Alarms include an alarm 655 installed within the garage and an alarm 656 installed within a residential house, which are connected to the control device 13 via the wires 659-*a* and 659-*b* respectively. The alarms 655 and 656 are actuated by an alarm circuit 326.

Next, prior to explanation of an example of operation of this system, the conditions for operation and processing of an abnormal condition will be defined below.

(1) Alarms against an intruder are operated at the same time for the garage and the residential house.

(2) In the garage, both the alarm 655 and the lamp 38 are turned on at the time of detection of an intruder.

(3) As long as the door 6 is stopped at a point other than the lower limit, the intruder detection is not processed.

(4) As long as the door 6 is moving or during the period of a predetermined length of time after stoppage of the door 6, the intruder detection is not processed.

(5) Upon detection of a fire, both the alarms in the garage and the residential house are actuated at the same time.

(6) Upon detection of a fire, the door 6 is moved up except in the case where the door 6 is stopped at the upper limit. This is to facilitate the fire extinguishing work on the one hand and transportation of the articles out of the garage on the other hand.

(7) This system is set or reset by a control switch 654 provided on the control device 13.

(8) The alarm system is adapted to be operated not only under an abnormal condition but also when the door 6 is moving down to warn any person near the door 6 to leave. In this case, however, the sound is flickered for distinction from the alarm against an abnormal condition. This applies only to the alarm 655 in the garage.

(9) The alarm is operated not only at the time of occurrence of an abnormal condition but also when the door 6 is moving up, in order to indicate that the door 6 is being operated. This sound is also flickered to distinguish from the detection of an abnormal condition. This applies only to the alarm 656 in the residence.

Figure 38:
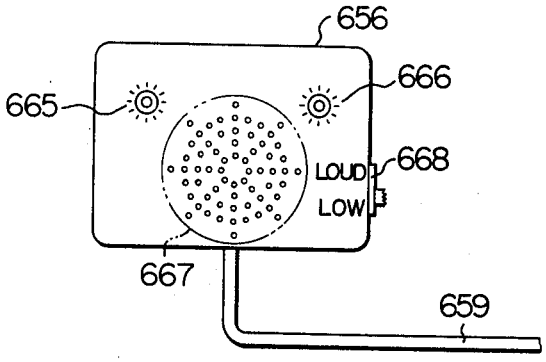
FIG. 38 is an outside view of an alarm installed within a residential house.

An example of the alarm 656 installed in the residence is shown in FIG. 38. Light-emitting diodes 665 and 666 are for indicating the conditions of the door 6, and make up a part of the door indicator circuit 325 in FIG. 8. These diodes are lit when the door 6 is moving, turned off when the door 6 is stopped at the lower limit, and lit when the door 6 is stopped at other than the lower limit, as already explained. The volume of the sound produced from the buzzer 667 is controlled by a volume change-over switch 668. This volume change-over switch 668 is provided to reduce the volume under normal operating conditions of the door 6 such as during upward movement of the door 6 when the sound is flickered. If the resident turns the volume change-over switch 668 to "high" when leaving the house, the buzzer 667 produces a high flicker sound when he returns and tries to open the garage. If an intruder is present in the house, he is threatened probably.

The process of operations of this system thus arranged will be explained with reference to the flowcharts of FIGS. 39 to 43. This process is inserted in the operation flowchart already explained and will be explained in parallel with the diagrams referred to above for facilitating the understanding of the sequence of operation.

Figure 39:
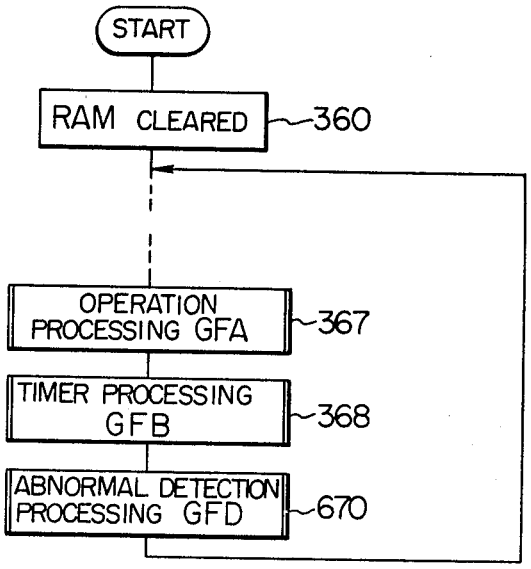
FIGS. 39 to 43 are flowcharts for an abnormal condition detecting process including the control of operation of the alarm.

The flowchart of FIG. 39 shows an abnormal condition detecting process 670 inserted in the main flowchart.

Figure 40:
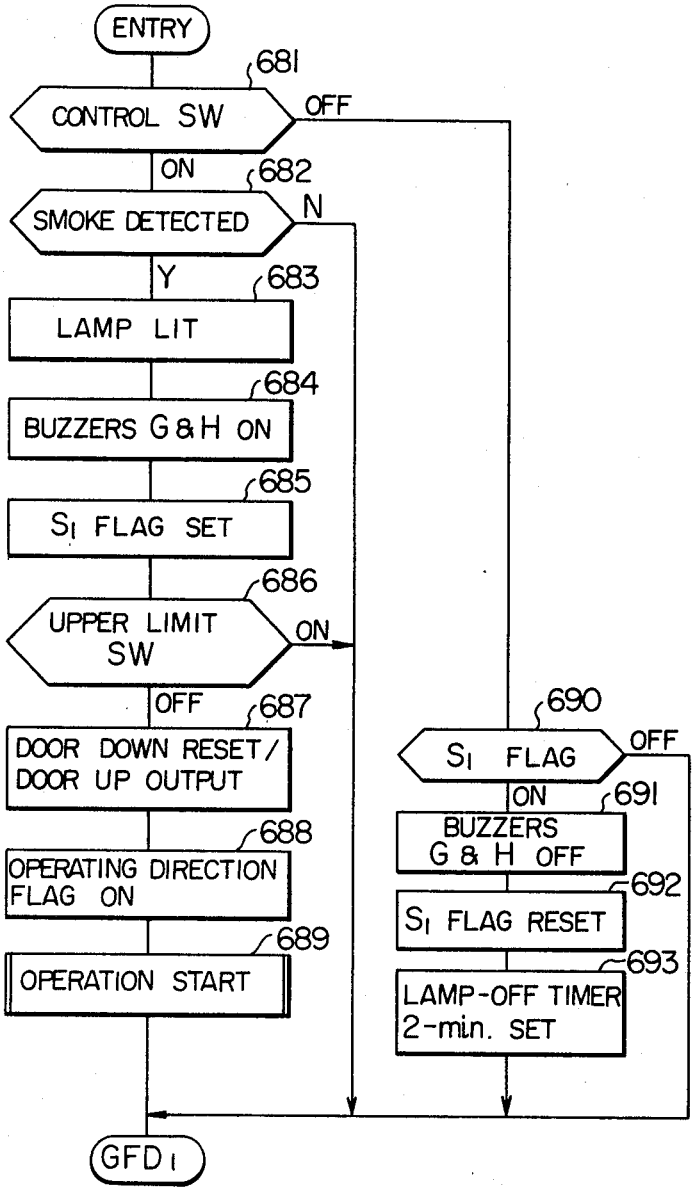

The flowchart of FIG. 40 shows the manner in which an input representing a fire is processed at the abnormal detection process 670. The control switch is checked at 681. If it is on, it is checked to see whether or not a fire has occurred or smoke is detected. If any fire has not occurred, a jump is made to GFC1. In the case where it has been confirmed that a fire has occured on the other hand, the lamp 38 is lit at 683, the buzzers G and H are turned on at 684 and the $S_1$ flag set 685 is processed. The buzzer G is one for the garage alarm 655 and the buzzer H is the buzzer 667 for the alarm 656 in the residential house. They may be referred to as G and H in the description that follows. The flag $S_1$ is one indicating the fire detection processing.

Next, the condition of the door 6 is checked. This step is taken at the upper limit switch check 686. If the door 6 is not at the upper limit, the door 6 is moved up forcibly. In other words, the door down reset/the door up output 687, the operating direction flag on 688, and the operation start 689 are taken. If the door is moving down, therefore, it turns to upward direction instantaneously. If the door is situated at the upper limit position, it naturally continues to stay there.

If the check of the control switch at 681 shows that the control switch is off, the flag $S_1$ is checked at 690. If it is off, a jump is made to GFC1. If it is on, by contrast, it is decided that a system release input has been applied from the fact that a fire has been detected followed by the turning off of the control switch. As a result, the buzzers G and H are turned off at 691, the flag $S_1$ is reset at 692, and the lamp off timer is set at 2 minutes at 693.

By taking the step of the lamp-off timer 2-minute set 693, the lamp 38 is turned off 2 minutes after the turning off of the control switch 654.

Figure 41:
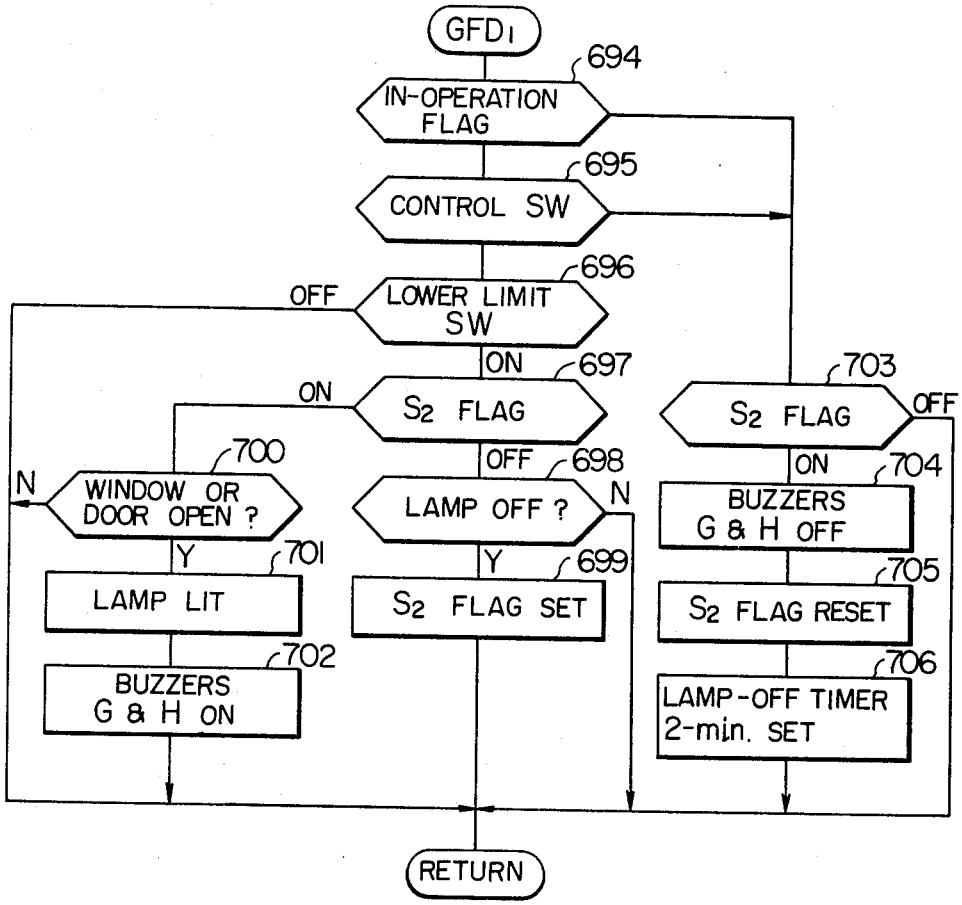

The flowchart of FIG. 41 shows the processing of an intruder prevention input at the abnormal detection process 670. The in-operation flag check 694 is taken thereby to decide whether the door is stationary or moving. If this flag is off, i.e., if the door is stationary, the control switch check 695 is taken as the next step. If the control switch is on, the lower limit switch check 696 is taken. If it is found that the lower limit switch is off, namely, if the door is stopped at other than the lower limit, a jump is made to the main flow (return step). If the lower limit switch is on, on the other hand, the $S_1$ flag check 697 is taken. If this flag $S_2$ is off, it means that the conditions for operation of the intruder prevention are not yet established. In other words, it has not yet passed a predetermined length of time after the door 6 stopped. Whether or not the lamp 38 is turned off is checked at 698. If the lamp 38 is turned off, the $S_2$ flag set 699 is taken. Thus by turning off the lamp 38, the intruder preventing functions begin to be performed.

If the $S_2$ flag check 697 shows that the flat is on, i.e., a predetermined length of time has passed after door stoppage, it is checked to see whether or not an intruder prevention input is applied. This means the checking of an open condition of the window 653 and the auxiliary door 660 at step 700. If they remain closed, a jump (return) is made to the main flow. If they are found open, by contrast, the lamp 38 is lit at 701, and the buzzers G and H are turned on at 702, thus threatening the intruder.

If the flag is found on as a result of the inoperation flag check 694, or if the control switch is found off as a result of the control switch check 695, the $S_2$ flag check 703 is taken. If this check shows that the flag $S_2$ is on, the buzzers G and H are turned off at 704, the flag $S_2$ is reset at 705, and the lamp off timer 2-minute set 706 is taken.

Figure 42:
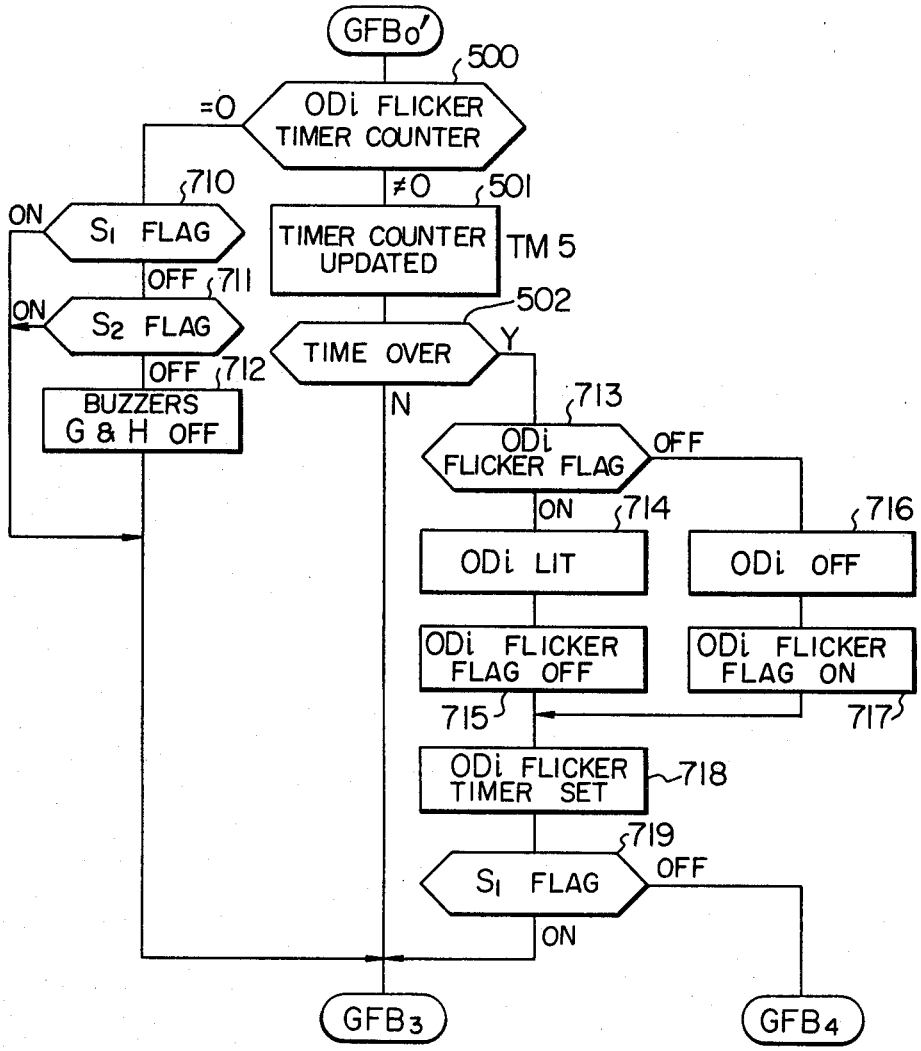
Figure 43:
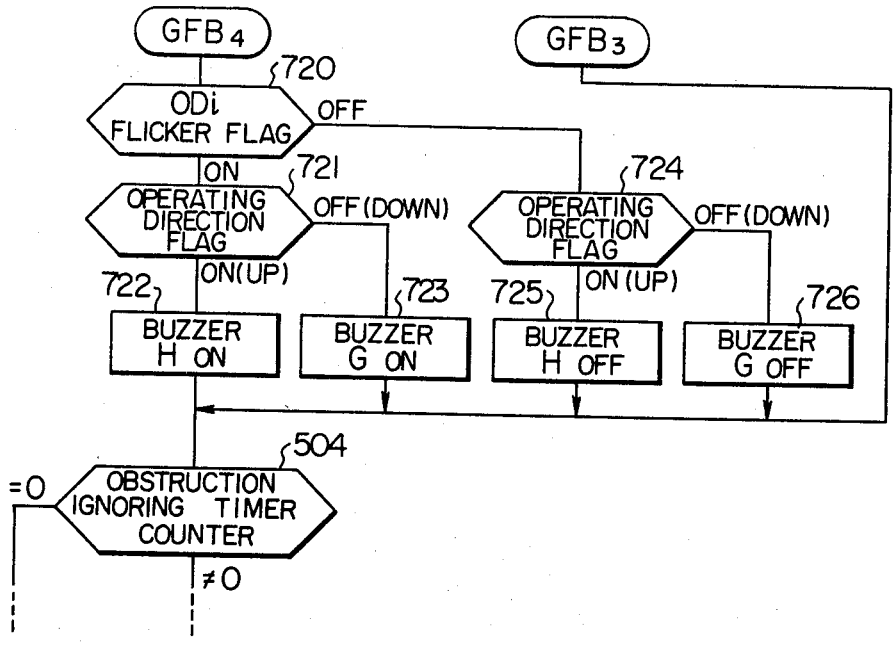

Next, examples using the alarms 655 and 656 are used to improve the safety of garage door operation will be explained with reference to FIGS. 42 and 43. In this case, the alarms indicate the operating condition of the door 6. This process is inserted in the ODi flicker processing flow described with reference to FIG. 25.

If the ODi flicker counter check 500 shows that the count is not zero, the timer counter (timer $TM_5$) is updated at 501, and the time over 502 is checked. If ODi time is over, the ODi flicker process is taken. The ODi flicker process means that the ODi flicker flag check 713 shows that it is on, the ODi on 714 and ODi flicker flag off 715 are taken, and if it is off, the ODi off 716 the ODi flicker flag on 717 and the ODi flicker timer set 718 are taken. In other words, the lamp on and off are repeated at regular intervals of time. Next, the $S_1$ flag check 719 is taken, and if it is on, a jump is made to GFB3, while if it is off, a jump is made to GFB4. When the flag $S_1$ is on, it indicates that a fire has been detected and is being processed while the door is moving up.

If the ODi flicker timer counter check 500 shows that it is zero, it indicates that the door is stopped, so that the $S_1$ flag check 710 and $S_2$ flag check 711 are taken. If both the flags are off, the buzzers G and H on 712 is taken.

From GFB4, the ODi flicker flag check 720 is taken. If this flag is on, the operating direction flag check 721 is taken. If the flag is on, the buzzer H on 722 is taken to sound the buzzer in the residential house, and if it is off, the buzzer G on 723 is taken to sound the buzzer in the garage. In other words, in accordance with the condition of the door 6, the buzzer G or H is selected for alarming.

If the step 720 shows that the ODi flicker flag is off, the buzzer H off 725 or the buzzer G off 726 is taken by taking the operating direction check 724.

The above-mentioned process enables the buzzer G to issue a flicker alarm when the door is moving down and the buzzer H to issue a flicker alarm if the door is moving up. The flags $S_1$ and $S_2$ are assigned to the space 0 in FIG. 10 between the ODi flicker and the door movement start.

Now, the alarms explained above with reference to FIG. 38 will be additionally explained below with reference to FIG. 44.

The diagram (a) shows the case in which for the purpose of switching the sound volume, a resistor 730 is connected in series with the buzzer 667. When the resistor is short-circuited by the volume change-over switch, the volume is increased, while when it is not short-circuited, the resistance is divided resulting in a low volume.

The case (b) uses an additional buzzer 731 which may alternatively be sounded by operating the volume change-over switch.

Another method of improving the present invention is by indicating the conditions by tone or tone quality in addition to volume.

Further, although a plurality of buzzers may be selectively operated manually, it may also be easily accomplished by the control device 13 automatically. Such an operation is very easily realized and therefore will not be explained here.

In this embodiment, the alarm for the garage is mounted on the garage wall. Instead, it may be mounted in the body 1 or on the side of the body 1 with equal effect.

In the above-mentioned embodiments of the present invention, the inputs from the abnormal condition detectors are connected by wires. In order to further improve the functions of the present invention, however, a method for transmitting such inputs without any wire may be employed. As an example, an embodiment using an electric wave will be explained with reference to FIG. 45.

A magnet 651 is mounted on the frame of the window 653, and a transmitter 735 including a reed switch 652 is mounted on the wall.

When the window 653 is opened, the reed switch 652 is turned off and the transistor 737 is turned on. As a result, the transistor 738 is also turned on, and the voltage from the battery 736 is applied to an RF oscillator 739 making up a UHF oscillation section. The RF oscillator 739 thus begins to oscillate.

The oscillated signal is received at a receiving circuit making up a regeneration circuit in the control device 13 and integrated at the integrator circuit 741. A comparator 742 checkes to see whether the electric wave continues for a predetermined length of time by comparison and accordingly produces an output. This signal is adapted to be applied to the same circuit to which the signal would otherwise might be applied through a wire.

In this case, however, this electric wave is different from the door-operating electric wave, and therefore a plurality of channels of different UHF oscillation frequencies are required.

If a bit code system is used as in the case of door operation thereby to identify an abnormal condition according to a code, the type of an abnormal condition is easily identified at the control device.

In the above-mentioned embodiments, two detectors including a fire detector and a intruder preventing device are used. The object of the present invention is achieved equally effectively by use of a gas sensor for detecting such a toxic gas as carbon monoxide. In the case where an output is produced from such a sensor, the door is automatically opened to introduce fresh air on the assumption that a person who may be in the garage has lost his consciousness. Further, by operating the alarm means, he is woken up and informed of the abnormal condition. This also informs nearby persons of the accident and urges them to improve the situation as early as possible.

In actual case, the same process as the fire detection process shown in FIGS. 39 to 41 may be followed.

In the foregoing description, the door is opened as an action to be taken after detection of a fire. Instead, if priority is given to prevention of the spread of the fire to a neighbouring house, it may be decided that the door be closed instead of opened.

For attaining this process, the upper limit switch check 686 in FIG. 40 is replaced by a lower limit switch check 686', followed by providing replacements including the door down output/door up reset 687' and the operating direction flag off 688'.

As explained above, according to this embodiment, the function of intruder prevention is performed by positioning the door 6 at the lower limit. For more effective utilization of this invention, however, an additional sensor is required to be added. In the case where the door is stopped with a small gap from the floor level for instance, it is sufficient to detect that the particular gap is not sufficiently wide to allow a human being in or out. Then there may be a case in which such a small gap as allowing a cat or dog to pass under the door, in which case the present invention also effectively functions. In actual case, such sensors as a magnet and a reed switch are used to confirm that the door is situated at such a special position. In this case, what is all required is to replace the lower limit switch check 696 in FIG. 41 by a reed switch check. If the reed switch is on the door is stopped with such a small gap as mentioned above which does not permit any human being to pass under the door; while if the reed switch is off, the door is stopped at other than that position.

The above-mentioned embodiments are such that the intruder preventing function is performed as soon as the lamp 38 is turned off, so that the particular function is indicated by the on-off operation of the lamp. In this case, the time set at the 2-minute timer may be too long, and therefore an exclusive timer for this purpose may be used. This timer may be started either after door stoppage or after the turning on of the control switch. The flowchart for the related process is easily conceivable and therefore will not be explained.

An application of the present invention will be described below. In the above-mentioned embodiments, time is counted for predetermined processing steps by use of part of the temporary memory circuit as counter means. Such a system, however, is low in configuration cost but not very high in speed. A method for improving the speed is by using separate means for counting the time, or specifically, a time counting circuit started by the program memory circuit and capable of being set at a predetermined time. Apart from this, a circuit which generates a timing pulse at regular intervals of time is connected to the input-output circuit so that the timing pulse input is processed in priority to the program in execution. By doing so, the number of such timing pulses is counted or an input signal of predetermined timing length is used for time counting. Such a process is generally called as an interruption control.

In the above-mentioned embodiments, the cyclical operation including upward movement, stop, downward movement and stop in that order is considered as an example of transfer of the basic conditions of the door operating device. Alternatively, applications of the present invention may concern changes in basic conditions as mentioned below.

Firstly, each time of receipt of an operating input signal, the movement and stop are repeated, and when the door operating device reaches the upper limit or lower limit position, it is stopped. In response to the next operating input signal, the operating direction is reversed so that the door is moved in compliance with the operating direction command. Instead of the above process, the upward movement and stop may be repeated, or the downward movement and stop may be repeated.

Further, the operating input signal in the above-mentioned embodiments does not directly indicate the direction of door movement. By providing the additional circuit with an up command switch and a down command switch, however, it is possible for the door to move in the direction designated by the switch impressed with an input signal. This is easily realized by adding a program of this process to the whole processing program.

Even in the above-mentioned embodiments, it is possible to directly designate the operating direction of the door. It is by adding a switch in parallel to the upper and lower limit switches in the circuit to which the outputs of the upper and lower limit switches are connected. In such a processing program, it will be easily seen that if the upper limit switch is turned on, a down command is issued and if the lower limit switch is turned on, an up command is issued.

The above-mentioned embodiments are such that the change in the condition after detection of an obstruction involves stoppage of the door if moving up, and the upward movement thereof for a predetermined length of time after stoppage for a predetermined length of time if moving down. The feature of the present invention lies in that the process after detection of the obstruction is controlled in accordance with the condition of the door in operation. Thus the control of the condition change process has such a freedom that in the case as mentioned above, the door may be reversed in direction, released from the stoppage for a predetermined length of time, or moved up to the upper limit position instead of a predetermined length of time.

Further, during the process after detection of an obstruction, it is possible not to accept another operating input signal, but only after completion of the same process.

As another process after detection of an obstruction, a new operating input signal may be accepted regardless of whether or not the previous signal is being processed.

In the above-mentioned embodiments, the operating time of the door operating device is so controlled that a condition is judged as abnormal if any condition detection signal for the door operating device fails to be applied within the operating time. According to the present invention, the operating time is controlled in the manner mentioned above and therefore it is sufficient to change the current condition of the door in operation to another condition as mentioned below. (1) The door operating device is stopped. (2) The door operating device is reversed in direction. (3) The door operating device, if being opened, is stopped, and if being closed, is opened for a predetermined length of time. (4) The door operating device, if being opened, is stopped and if being closed, is opened.

In the case of (2), (3) or (4) above where the door operating direction is reversed, the door may be stopped for a predetermined length of time beforehand. Also, during this process, a new operating input signal may or may not be accepted.

In the above-mentioned embodiments, a detection input from the condition detectors is not given priority in the sequence of execution. In spite of this, the signal from the condition detectors may be processed prior to the program in execution in what is generally called an interruption control.

Furthermore, it is of course possible to improve the system performance of the door operating device by adding a safety device or giving priority to a specific input signal as mentioned above.

An embodiment of the present invention has the advantages as mentioned below. (1) Upon issue of an operating command to the garage door, the intruder prevention function is automatically cancelled thus permitting easy access to the inside of the garage. (2) As long as the garage door is stopped at a position other than the lower limit, the intruder prevention function fails to work, and therefore while a worker(s) is doing the job in the garage, the auxiliary door or the window is freely opened or closed. (3) In view of the facts (1) and (2), the control switch may be left on and therefore it never happens that an accident is caused by forgetting to set it. (4) At the time of a fire, the door automatically opens so that articles are carried out conveniently and the fire extinguishing work is facilitated. (5) In response to an intruder prevention input signal, the buzzer sounds while at the same time illuminating the inside of the garage, thus sufficiently threatening the intruder.

Next, an embodiment of the control apparatus will be described with reference to FIG. 46. Reference numeral 12 shows a push button switch for issuing a door operation command, numeral 201 a relay contact output for issuing a door operation command from a radio receiver, numeral 30 a door upper limit switch, numeral 31 a door lower limit switch, numeral 52 and obstruction detection limit switch, numeral 205 a power supply reset circuit for producing a reset signal at the rise of the power supply, numerals 206 and 207 monostable multivibrators, numeral 208 a J-K master slave flip-flop, numeral 209 a timer circuit using NE555 (of Signetics Corporation), numerals 210 and 211 D-type flip-flop, numeral 212 an integrator circuit, numeral 213 a differentiator circuit, numerals 214 to 222 NOT elements, numeral 233 a 2-input OR element, numerals 224 to 228 2-input AND elements, numerals 229 and 230 4-input NOR elements, numeral 231 a 2-input NOR elements, numeral 232 a 3-input AND element, numeral 233 a transformer for control power source, numeral 234 a diode stack, numeral 235 an IC regulator for the control power supply, numerals 236 to 238 relay-driving transistors, numerals 239 to 241 relay coils, numerals 242 to 244 contracts of the realys, numeral 245 a door operating driving motor, and numeral 38 a lamp.

The operation of this circuit will be explained below with reference to the time charts of FIGS. 47 and 48. When power is thrown in this circuit, a control power VDD is supplied from the transformer 233 through the diode stack 234 and the IC regulator 235. The rise of this signal VDD is integrated by the power supply reset circuit 205, so that a reset pulse is produced through the NOT element 215. The reset pulse resets the J-K master slave flip-flop 208 through the NOT element 216, and further resets the D-type flip-flops 210 and 211 through the 4-input NOR elements 229 and 230. Assuming that the relay contact output 201 connected with the push button switch 12 or the radio receiver for issuing a door operation command is turned on and the NOT element 214 produces a signal A, the monostable multivibrator 206 produces a signal B of pulse width T1 at the rise point of the signal A. This signal B is applied to the 2-input OR element 223 and the 2-input AND element 224 thus producing a signal C. The signal C is applied as a clock pulse signal to the J-K master slave flip-flop 208. During the high state of the signal C before reversal of the output signal E, the outut of the 2-input AND element 226 is applied as a clock input signal to the flip-flop 210, so that the flip-flop 210 is set, thereby producing a signal F. With this signal as a door up drive command, the transistor 237 excites the relay coil 240 for door upward movement. Thus the relay contact 242 is turned on, thus driving the motor 16 in forward direction. In this way, the motor 16 is started. At the same time, the signal B is applied as a trigger signal to the timer circuit 209 through the NOT element 221. This operation is intended to keep the lamp 38 on for a predetermined length of time after the issue of the door operation command for illuminating the inside of the garage simultaneously with the start of the motor 16. For this purpose, the output of the timer circuit 209 excites the relay coil 239 through the transistor 236, thus and turns on the relay contact 244. As a result, the lamp 38 is lit for a predetermined length of time. Next, if the upper limit switch 30 is turned on during the production of an up command output, the flip-flop 210 is reset through the NOT element 217 and the 4-input NOR element 229, so that the transistor 237 is turned off, the relay coil 240 is de-energized, the relay contact 242 is turned off, and the motor 16 stops. In the case where an operation command is issued again, that is, the relay contact output 201 from the radio receiver or the push button switch 12 is turned on during the production of the up command, on the other hand, the pulse signal B is produced from the monostable multivibrator 206 as mentioned above, so that an output is produced from the OR element 223. In view of the fact that the flip-flop 210 is set, however, the output of the 2-input AND element 228 is "low", thus prohibiting the output of the 2-input AND element 224. The output of the NOT element 218 is "high", and therefore, the pulse signal B is produced in the form of signal D from the 2-input AND element 227. This signal D is applied through the 4-input NOR element 229 to the flip-flop 210 as a reset signal. In this way, the motor 16 is stopped in this case, too. Upon receipt of another operating command, the output of the 2-output AND element 226 is prohibited in view of the fact that J-K master slave flip-flop 208 is set, so that the signal B is produced from the 2-input AND element 225 and the flip-flop 211 is set, thus producing the signal G. As a result, the transistor 238 is turned on, the door down drive relay coil 241 is excited, the relay contact 242 is turned on, the motor 16 is driven in the reverse direction, and thus the door is moved down. If the lower limit switch 31 is turned on during the downward movement, a signal H is produced from the NOT element 219 and, after being delayed by time T2 at the integrator circuit 212, applied as a reset signal to the flip-flop 211 via the 4-input NOR element 230. In this way, the motor 16 is stopped as in the case of the upper limit switch being turned on during upward movement. Next, the operation of the circuit with the obstruction detection limit switch 204 turned on will be explained.

Assume that the obstruction detection limit switch 204 is turned on when the door is moving up, i.e., when the J-K master slave flip-flop 208 is set, the flip-flop 210 is set and the flip-flop 211 is reset. In view of the fact that the limit switch 204 is closed at contact B, it is turned off. Thus, a "high" signal is produced from the 2-input NOR element 231 through the NOT element 220 and triggers the monostable multivibrator 207. The Q output pulse of the monostable multivibrator 207 resets the flip-flop 210 through the 4-input NOR element 229. At this time, the J-K master slave flip-flop 208 is set and therefore the output of the 4-input AND element 232 is prohibited. Next, assume that the obstruction detection limit switch 204 is turned on during the downward movement, i.e., when the J-K master slave flip-flop 208 is reset, the flip-flop 210 is reset and the flip-flop 211 is set. A signal J is produced from the NOT element 220, and a signal K with pulse width T3 is produced from the monostable multivibrator 207 via the 2-input NOR element 231. This signal K resets the flip-flop 211 through the 4-input NOR element 230. As a result, the motor is stopped and the door stops moving down. Further, at the fall point of the pulse signal K, the output Q of the monostable multivibrator 207 rises so that the output of the 3-input AND element 232 becomes "high" and a signal L is produced. This signal L is converted into a signal M through the differentiator circuit 213 and the NOT element 222 and applied to the 2-input OR element 223. In this way, a signal F which is an up command is produced from the above-mentioned control process, with the result that the door moves up and stops in response to an output signal N of the NOT element 217 which is produced from the upper limit switch 30. As will be seen from above, when the door detects an obstruction, the movement thereof is immediately stopped if moving up, and it is immediately stopped and begins to move up after the time period of T3 if moving down, thus securing the operating safety. In order to prevent the obstruction detection means from being unduly actuated by a small obstacle such as a stone or a rod located near the door lower limit or the rise of the floor level due to snow in winter, the turning on of the lower limit switch 31 causes the 2-input NOR element 231 to immediately prohibit the operation of the obstruction detection, while the signal G making up a down command is reset by a signal I with time delay T2 produced from the integrator circuit 212. This control process assures safe door operation without any inconveniences.

Figure 49:
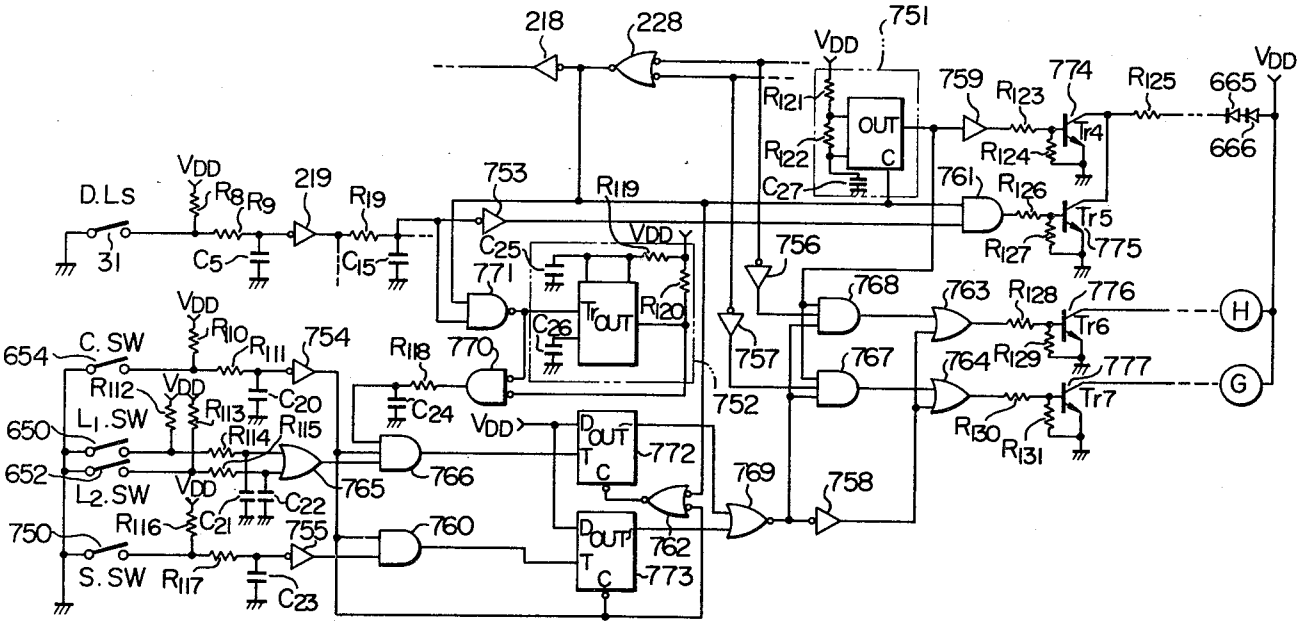

An embodiment of the circuit according to the present invention will be explained below with reference to FIG. 49.

Numeral 750 shows a contact output of the fire detector, numeral 751 is a timer circuit using NE555 of Signetics Corporation or the like, numeral 752 is a one-shot multivibrator circuit using NE555 of Signetics Corporation or the like, numerals 753 to 758 are inverter elements, 759 is a buffer element, numerals 760 to 762 are 2-input AND elements, numerals 763 to 765 are two-input OR elements, numerals 766 to 768 are 3-input AND elements, 769 and 770 are 2-input NOR elements, numeral 771 is a 2-input NAND element, numerals 772 and 773 are D-type flip-flops (which hereinafter may be referred to as FF), and numerals 774 to 777 are transistors.

When the output of the AND element 228 is "high", it indicates that the door is stationary; while when the same output is "low", the door in operation is indicated. When the output of the AND element 228 is low, the timer circuit 751 is actuated, so that the light-emitting diodes 665 and 666 are driven through the buffer element 759 and the transistor 774. The period of the timer is set at 0.5 seconds.

When the door is stopped, the light-emitting diodes 665 and 666 will be turned off. In the case where the checking of the inverter element 753 and the AND element 761 shows that the door is not at the lower limit, however, the light-emitting diodes 665 and 666 continue to be kept on by the transistor 775, although the light-emitting-diodes 665 and 666 remain turned off when the door is at the lower limit position.

The output of the timer circuit 751 is also applied to each terminal of the 3-input AND elements 767 and 768. Each terminal of the 3-input AND elements 767 768 is impressed with a door operating direction command through the inverter elements 756 and 757. Another terminal of each of the 3-input AND elements 767 and 768 is impressed with an abnormal condition detection signal although the same terminal is maintained "high" normally. Thus the 3-input AND element 768 actuates the buzzer 667 in the residential house through the 2-input OR element 763 and the transistor 776 while the door is moving up. In similar fashion, the 3-input AND element 767 actuates the buzzer 647 in the garage through the 2-input OR element 764 and the transistor 777 while the door is moving down.

The control switch 654, the reed switches 650 and 652 and the contact 750 are connected via a filter circuit to the inverter element 754, the 2-input OR element 765 and the inverter element 755 respectively. The flip-flops 772 and 773 are always cleared when the control switch 654 is turned off. The flip-flop 772, on the other hand, is cleared also by the operation of the door in view of the fact that the signal indicating the door in operation is applied to the 2-input AND element 762.

When the contact 750 is on, the flip-flop 773 is set through the AND element 760, while at the same time actuating the buzzers 647 and 667 through the 2-input NOR element 769, the inverter element 758, the 2-input OR elements 763 and 764 and the transistors 776 and 777.

The reed switches for detecting the open condition of the window or the auxiliary door are actuated through the one-shot multivibrator 752 by the 2-input NAND element 771 after the door stops at the lower limit point. In other words, before the timer is up, the output of the 2-input NOR element 770 fails to reach the high level and therefore the 3-input AND element 766 does not produce any output. After the timer is up, the signals from the reed switches 650 and 762 are accepted and if a detection input signal is applied, the flip-flop 772 is set, thereby actuating the buzzers 647 and 667 through the 2-input NOR element 769, the inverter element 758, the 2-input OR elements 763 and 764 and the transistors 776 and 777.

It will be understood from the foregoing description that according to the present invention the garage door operation and the processes after detection of an abnormal condition in the garage are controlled by a single system. As a result, a highly safe garage door control system is realized, thereby greatly contributing to improvement in the system.

What is claimed is:

1. A garage door operation control apparatus comprising:

door operating means for operating a main door of a garage to effect opening and closing operation thereof between upper and lower positions;

command means for ordering the operation of said main door;

means including a lower limit switch and an upper limit switch for detecting a lower limit position and an upper limit position of said main door;

auxiliary detector means for detecting at least one abnormal condition including the opening of a garage window, the opening of an auxiliary door, the occurrence of a fire in the garage and the generation of a special gas in the garage;

a lamp for illuminating the inside of the garage;

an alarm; and electrical control means electrically connected to said door operating means, said command means, said lower limit switch, said upper limit switch, said auxiliary detector means, said lamp and said alarm; wherein said electrical control means comprises:

means for controlling said door operating means to operate said main door when said electrical control means receives a command signal for the main door operation from said command means;

means for controlling said door operating means to stop said main door when said electrical control means receives a detected signal representative of the presence of said main door at one of said lower and upper limit positions from said lower limit switch and said upper limit switch;

means for turning on said lamp during a predetermined time in connection with the control of said door operating means; and means for turning on said lamp and said alarm when said electrical control means simultaneously receives a detected signal representative of said lower limit position of said main door from said lower limit switch and a detected signal representative of said abnormal condition from said auxiliary detector means.

2. A garage door operation control apparatus according to claim 1, wherein said electrical control means comprises means for turning on said lamp and said alarm when said electrical control means simultaneously receives said detected signal representative of said lower limit position of said main door from said lower limit switch and a detected signal representative of the opening of said garage window or said auxiliary door from said auxiliary detector means.

3. A garage door operation control apparatus according to claim 1, wherein said electrical control means comprises means for controlling said door operating means to open said main door when said electrical control means receives a detected signal representative of the occurrence of said fire or the generation of said special gas while said electrical control means does not receive a signal representative of said upper limit position of said main door from said upper limit switch.

4. A garage door operation control apparatus according to claim 1, wherein said electrical control means comprises means for intermittently turning on said alarm while said door operating means is controlled by said command signal from said command means to move said main door to said lower limit position.

5. A garage door operation control apparatus according to claim 1, wherein said alarm is installed in a residence.

6. A garage door operation control apparatus according to claim 1 or 5, wherein said alarm is a buzzer.

7. A garage door operation control apparatus according to claim 6, wherein said buzzer includes volume change-over means for controlling the volume of the sound produced therefrom.

8. A garage door operation control apparatus comprising:

door operating means for operating a main door of a garage to effect opening and closing operation thereof between upper and lower positions;

command means for ordering the operation of said main door;

main detector means for detecting a lower limit position and an upper limit position of said main door;

auxiliary detector means for detecting at least one abnormal condition including the opening of a garage window, the opening of an auxiliary door, the occurrence of a fire in the garage and the generation of a special gas in the garage;

a lamp for illuminating the inside of the garage;

an alarm; and electrical control means electrically connected with said door operating means, said command means, said main detector means, said auxiliary detector means, said lamp and said alarm; wherein said electrical control means comprises:

means for controlling said door operating means to operate said main door when said electrical control means receives a command signal for the main door operation from said command means;

means for controlling said door operating means to stop said main door when said electrical control means receives a detected signal representative of one of said lower and upper limit positions from said main detector means;

means for turning on said lamp during a predetermined time in connection with the control of said door operating means; and means for turning on said lamp and said alarm when said electrical control means simultaneously receives a detected signal representative of said lower limit position of said main door from said main detector means and a detected signal representative of said abnormal condition from said auxiliary detector means.

9. A garage door operation control apparatus according to claim 8, wherein said electrical control means comprises means for controlling said door operating means to open said main door when said electrical control means receives a detected signal representative of the occurrence of said fire or the generation of said special gas while said electrical control means does not receive a signal representative of said upper limit position of said main door from said main detector means.

10. A garage door operation control apparatus according to claim 8, wherein said electrical control means comprises means for intermittently turning on said alarm while said door operating means is controlled by said command signal from said command means to move said main door to said lower limit position.

11. In a garage door operation control apparatus comprising door operating means for operating a main door of a garage to effect opening and closing thereof, command means for selectively ordering the operation of said main door, main detector means for detecting the operating condition of said main door, auxiliary detector means for detecting at least one abnormal condition including a garage window open, an auxiliary door open, a fire in the garage and generation of a special gas, alarm means, and electrical control means electrically connected to said door operating means, said command means, said main detector means, said auxiliary detector means and said alarm means to effect control of said door operating means and said alarm means; the improvement wherein said electrical control means includes signal processing means for controlling said alarm means by logically analyzing electrical signals produced from said main detector means and said auxiliary detector means, including means for actuating said alarm means only in response to simultaneous application thereto of an electrical signal indicating the closed condition of said main door as derived from said main detector means and an electrical signal indicating an abnormal condition from said auxiliary detector means.

12. A garage door operation control apparatus according to claim 11, wherein said main detector means includes upper limit switch means for producing an output indicating the presence of the main door at a fully open position and lower limit switch means for producing an output indicating the presence of the main door at a fully closed position, said means for actuating said alarm means being connected to receive the output of said lower limit switch means and said auxiliary detector means.

13. A garage door operation control apparatus according to claim 12, wherein said electrical control means further includes means for controlling said door operating means to open said main door when said electrical control means receives an output from said auxiliary detector means representative of the occurrence of a fire or the generation of a special gas while said electrical control means does not receive said output from said upper limit switch means.

14. A garage door operation control apparatus according to claim 12, wherein said electrical control means further includes means for intermittently turning on said alarm while said door operating means is controlled by said command means to move said main door toward its fully closed position.

* * * * *